US006689432B2

(12) United States Patent
Kitamura et al.

(10) Patent No.: US 6,689,432 B2
(45) Date of Patent: Feb. 10, 2004

(54) INK JET RECORDING MATERIAL

(75) Inventors: Ryu Kitamura, Chiba (JP); Tomomi Takahashi, Tokyo (JP); Eriko Endo, Urawa (JP); Kazuaki Ohshima, Yokohama (JP); Shunichiro Mukoyoshi, Urayasu (JP); Tetsuo Tsuchida, Takarazuka (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 09/769,318

(22) Filed: Jan. 26, 2001

(65) Prior Publication Data

US 2001/0016249 A1 Aug. 23, 2001

(30) Foreign Application Priority Data

| | | |
|---|---|---|
| Jan. 28, 2000 | (JP) | 2000-019758 |
| Mar. 27, 2000 | (JP) | 2000-086939 |
| Sep. 14, 2000 | (JP) | 2000-280504 |
| Sep. 14, 2000 | (JP) | 2000-280557 |

(51) Int. Cl.[7] ..... B41M 5/00

(52) U.S. Cl. ..... 428/32.37; 428/32.25; 427/152

(58) Field of Search ..... 428/195, 323, 428/331, 328, 32.25, 32.37; 427/152

(56) References Cited

U.S. PATENT DOCUMENTS

| | | | | |
|---|---|---|---|---|
| 5,041,328 A | * | 8/1991 | Akiya et al. | 428/212 |
| 6,096,157 A | * | 8/2000 | Imabeppu et al. | 427/261 |
| 6,129,785 A | * | 10/2000 | Schliesman et al. | 106/482 |
| 6,183,851 B1 | * | 2/2001 | Mishima | 428/304.4 |
| 2001/0016248 A1 | * | 8/2001 | Alderfer et al. | 428/195 |

FOREIGN PATENT DOCUMENTS

| | | |
|---|---|---|
| JP | 57-87988 | 6/1982 |
| JP | 60-46288 | 3/1985 |
| JP | 60-219084 | 11/1985 |
| JP | 61-146591 | 7/1986 |
| JP | 63-162275 | 7/1988 |
| JP | 1-241487 | 9/1989 |
| JP | 2-43083 | 2/1990 |
| JP | 2-274587 | 11/1990 |
| JP | 4-201594 | 7/1992 |
| JP | 7-89220 | 4/1995 |
| JP | 8-67064 | 3/1996 |
| JP | 8-118790 | 5/1996 |
| JP | 8-132727 | 5/1996 |
| JP | 8-132731 | 5/1996 |
| JP | 8-132736 | 5/1996 |
| JP | 8-324098 | 12/1996 |
| JP | 9-286162 | 11/1997 |
| JP | 9-286165 | 11/1997 |
| JP | 9-290556 | 11/1997 |
| JP | 10-157277 | 6/1998 |
| JP | 10-193776 | 7/1998 |
| JP | 10-217601 | 8/1998 |
| JP | 10-250218 | 9/1998 |
| JP | 11-20306 | 1/1999 |

(List continued on next page.)

*Primary Examiner*—B. Hamilton Hess
(74) *Attorney, Agent, or Firm*—Armstrong, Kratz, Quintos, Hanson & Brooks, LLP

(57) ABSTRACT

An ink jet recording material having excellent smoothness and gloss and capable of recording thereon ink images having high color density clarity, water resistance and sharpness comparative to the silver salt photographic images has a recording stratum formed on a substrate and comprising a single ink receiving layer or a plurality of ink receiving layers superposed on each other and containing a pigment and a binder, at least one ink receiving layer containing fine particles of at least one pigment selected from silica, aluminosilicate, and α-, θ-, δ- and γ-aluminas and having an average particle size of 1 μm or less and optionally a light resistance-enhancing agent for images including at least one of phenolic compounds, boric acid, borate salts and cyclodextrin compounds.

40 Claims, 2 Drawing Sheets

FOREIGN PATENT DOCUMENTS

| | | |
|---|---|---|
| JP | 11-192777 | 7/1999 |
| JP | 11-198520 | 7/1999 |
| JP | 11-263065 | 9/1999 |
| JP | 11-286172 | 10/1999 |
| JP | 2000-73296 | 3/2000 |

* cited by examiner

INK JET RECORDING MATERIAL

BACKGROUND OF THE INVENTION

1. Field of the Invention

The present invention relates to an ink jet recording material capable of recording ink images having a high color density, a high clarity, a high water-resistance, a high resistance to blotting of ink images due to a high humidity and optionally a high resistance to fading, and having a high surface smoothness and a high gloss. The ink jet recording material of the present invention enables sharp ink images, comparable to those of silver-salt photographic images, to be recorded thereon.

2. Description of the Related Art

The ink jet recording system is a system for recording ink images by jetting ink droplets, corresponding to images to be recorded, toward a recording medium to cause the jetted ink droplets to be directly absorbed, imagewise, into the recording medium.

An ink jet printer can easily effect multi-color recording on the recording medium and thus is now rapidly becoming popular, for home use and for office use, as a text- or picture-outputting machine for computers.

The multi-color recording system using the ink jet recording system can rapidly and accurately form complicated images and the quality (color density and clarity) of the recorded colored images is comparable to the quality of color images formed by a conventional printing system using a printing plate or by conventional color photography. In the case where the ink jet recording system is utilized for a small number of prints, the ink jet recording system is advantageous in that the cost for recording is lower than the printing cost of a conventional printing system or a conventional photographic printing system. The progress in the accuracy and color quality of the printer and an increase in the printing speed of the printer require the printing media to have an enhanced performance. High gloss is required and also, since the ink for the ink jet recording system contains a large amount of water or another liquid medium, particularly a liquid medium having a high boiling temperature to prevent a blocking of the ink jet nozzle heads and, after printing, the coloring material such as a dye exists together with the liquid medium for a long period in the recording layer, the conventional recording material is disadvantageous in that the ink images are blotted with the lapse of time and the stabilization of the color tone of the printed ink images is difficult.

To enhance the resistance of ink images printed on an image recording stratum to moisture, a plurality of attempts have been made. For example, in one attempt, a uniform aqueous solution or an emulsion latex of a cationic polymer is added to the ink or, in another attempt, fine solid particles having a cationic surface charge (for example, alumina particles or cation-modified silica particles are added to the ink.

For example, Japanese Unexamined Patent Publication No. 60-46,288 discloses an ink jet recording method using a recording material comprising an ink containing a specific dye and a polyamine, etc. Also, Japanese Unexamined Patent Publication No. 63-162,275 discloses an ink jet recording material comprising a cationic polymer and a cationic surfactant coated on or impregnated in a support. Further, use of fine inorganic cationic particles, for example, alumina or cation-modified silica particles is known, for example, from Japanese Examined Patent Publication No. 4-19,037 and Japanese Unexamined Patent Publication No. 11-198,520. The attempts mentioned above relatively greatly contributed to enhancing the water resistance of the printed ink images. However, the enhancing effect on the resistance to blotting of the ink images due to moisture is insufficient and, particularly, substantially no effect was found on stabilization of the color tone of the printed ink images within a short time.

To solve the above-mentioned problems, Japanese Unexamined Patent Publication No. 10-157,277 discloses an attempt in which a two-layered image recording stratum is formed on an opaque support, the opaqueness of an under layer is made higher than the opaqueness of the upper layer, and a white-coloring pigment is contained in the under layer. In this attempt, since the upper layer is formed transparent and the under layers is formed opaque, the portion of the dye of the ink absorbed in the under layer which dye may blot in the under layer, is hidden from sight in the opaque layer and thus cannot be recognized through the upper layer. In this attempt, a certain degree of effect is recognized, but the problems are not completely solved. Particularly, the dye absorbed and blotted in the under layer further spread into the upper layer with the lapse of time and as a final result, an ink image-blotting phenomenon appears. Also, by this attempt alone, it is difficult to stabilize the color tone of the printed ink images within a short time. Particularly, for a specific use in which the stabilization of the color tone within a short time is required, for example, the use of checking the color tone of ink images formed by an ink jet recording system for the purpose of proofreading of colored images of prints, the above-mentioned recording stratum is unsatisfactory.

Currently, since digital cameras have become popular and ink jet printers using a photo-ink, capable of recording images having a high accuracy and having a low price are available, a demand of recording material capable of recording thereon ink images having a high quality comparable to that of silver-salt photographic images is increased. Since the printers can record full-colored ink images at high speed with a high quality and accuracy, the recording material for the printers are also required to provide with further enhanced properties. Particularly, to use the ink jet recording system in place of the silver-salt photographic printing system, the ink jet recording materials are strongly required to have a high ink-absorbing rate, a high ink absorption capacity, a high roundness of dots, a high density of colored images, and high surface gloss and a smoothness comparable to those of silver salt photographic printing sheets.

To realize the high clarity and color density of the ink images comparable to the silver-salt photographic image, the inventors of the present invention provided, in Japanese Unexamined Patent Publication No. 9-286,165, an ink jet recording material having at least one ink receiving layer comprising fine silica particles having an average primary particle size of 3 to 40 nm and an average secondary particle size of 10 to 300 nm, and water-soluble resin. The fine silica particles contribute to enhancing the color-forming property of the ink and the clarity and brightness of the printed images.

Also, the use of the fine silica particles enables the printed images to exhibit a high color density and a high quality (clarity). However, since the silica particles exhibit an anionic property, the resultant images formed from a cationic dye ink exhibit an unsatisfactory water resistance. Also, a cationization treatment of silica particles is difficult. Further, the silica particle-containing recording stratum is disadvantageous in that the resultant smoothness and gloss thereof, without a gloss-providing treatment, are insufficient.

In another invention disclosed in Japanese Unexamined Patent Publication No. 10-193,776, an ink jet recording material having an ink-receiving and recording layer comprising fine silica particles having an average primary particle size of 20 $\mu$m or less and a hydrophilic binder, is provided. Particularly, in this recording material, when fumed silica particles are used as the fine silica particles, a high gloss of the recording stratum can be obtained, and the ink exhibits a good color-forming property. However, the resultant gloss of the recording material is lower than that of the silver-salt photographic material. Also, the fumed silica particles are difficult to cationalization process. Further, the fumed silica particles are disadvantageous in that since the thixotropic property thereof is too high and thus the resultant coating liquid containing the fumed silica particles exhibits a poor stability in storage.

Currently, various types of ink jet recording materials containing alumina hydrate particles are provided. For example, Japanese Unexamined Patent Publication No. 8-324,098 discloses a process for producing an ink jet recording material in which a coating liquid containing alumina hydrate particles dispersed by high speed aqueous streams is employed. When the alumina hydrate particles dispersed by the high speed aqueous streams are employed, a recording stratum having a high transparency can be formed, but this recording stratum is disadvantageous in that the dispersion of the alumina hydrate particles causes the ink-absorbing property of the recording stratum to be decreased. Also, the alumina hydrate particle-containing recording stratum is unsatisfactory in the color-forming property of the dye in the ink and thus clear and sharp images cannot be obtained. A plurality of inventions relating to ink jet recording materials containing alumina hydrate particles having a boehmite structure are provided. The alumina hydrate particles having the boehmite structure exhibit a high laminating property and enable a recording stratum having a high gloss and a high smoothness to be obtained. Also, the resultant recording stratum exhibits a high transparency and the images printed on the recording stratum have a high color density. However, this type of recording stratum has a low ink absorption and thus is difficult to use practically. Also, the alumina hydrate particle-containing recording stratum has an insufficient color-forming property for the dye of the ink and thus clear and bright colored images are not obtained on the recording stratum.

Generally speaking, as a method of imparting a high gloss to a recording material, a method of smoothing a surface of a coating layer of the recording material by feeling the recording material to a smoothing apparatus, for example, a calender, and passing the recording material between a pair of pressing and heating rolls under pressure, is known. When only the above-mentioned conventional procedure is applied, the resultant gloss of the recording material is insufficient. Also, since the press-heating procedure causes the ink-absorbing pores formed in the coating layer to be decreased, as a result, the smoothed coating layer easily allows the printed ink images to be blotted. Particularly, in the current ink jet printing system, to form ink images having a photographic image-like tone but no roughened surface-like tone, printers having photoink-jetting nozzles through which low concentration ink images are superposed on each other are mainly used. Thus, the recording material is required to have a further enhanced ink absorption.

Various types of methods of forming an ink-receiving layer from an ink-absorbing polymeric material, for example, starch, gelatin, a water-soluble cellulose derivative, polyvinyl alcohol or polyvinyl pyrrolidone on a plastic film or a resin-coated paper sheet having a high gloss and a high smoothness, are known. The recording materials produced by the above-mentioned methods have a sufficiently high gloss. However, this type of recording materials exhibit a low ink absorption and a low ink-drying rate and, thus, the handling property of the recording material is insufficient, the ink is unevenly absorbed in the recording material, and the water-resistance and the resistance to curling of the recording material are insufficient.

As means for solving the above-mentioned problems, Japanese Unexamined Patent Publications No. 2-274,587, No. 8-67,064, No. 8-118,790, No. 9-286,162 and No. 10-217,601 disclose a coating layer containing, as a main component, super fine pigment particles. Among them, coating layers containing colloidal silica particles having a small particle size (disclosed in Japanese Unexamined Patent Publications No. 2-274,857, No. 8-67,064, and No. 8-118,790 have a high gloss and high water resistance. However, since the colloidal silica particles are primary particles independent from each other and thus fine pores for absorbing the ink cannot be formed between the particles, and the ink-absorbing properties of the coating layers are unsatisfactory for practical use.

Also, Japanese Unexamined Patent Publication No. 2-43,083 discloses a recording material having a surface layer comprising, as a main component, an aluminum oxide and an under layer having an ink absorbing property, as a recording material having a high resistance to fading of the recorded images, because the dye for the images is electrically bonded with the aluminum oxide particles and thus exhibits a high resistance to decomposition.

As mentioned above, the ink jet recording system in which an aqueous ink is jetted imagewise in the form of fine droplets through fine nozzles toward a recording material and ink images are formed on the surface of the recording material is advantageous in that the printing noise is low, full colored images can be easily formed, a high speed recording can be effected, and the recording cost is cheaper than that of other conventional recording systems. Thus, the ink jet recording system is widely employed as an output terminal printer, as a printer for facsimile machines plotters and as a printing system for notebooks, slips and tickets.

Due to the fact that the use of the printers is rapidly expanding, the accuracy and minuteness of the printed images have improved, the printing speed has increased and that digital cameras have been developed, the recording materials are required to have improved properties. Namely, a recording materials having a high ink-absorbing property, a high color density of recorded images, a high water resistance, a high light resistance, and a quality (clarity) and durability of the recorded images comparative to those of the silver-salt type photographic sheets, are in strong demand. Further, to obtain a photographic tone image, the recording material surface must have a high gloss.

As a recording sheet having a high surface gloss, a cast-coated paper sheet produced by contacting a wetted coating layer of the recording sheet with a mirror-finished peripheral surface of a heating drum under pressure, and drying the coating layer to transfer the mirror-like surface to the coating layer surface, is known. The cast-coated paper sheet has a higher surface gloss, a more superior surface smoothness, and a more excellent printing effect than those of the conventional super calender-finished coating sheet, and thus is mainly used for high quality prints. However, when the cast-coated paper sheet is used as an ink jet recording material, various problems occur.

Namely, the conventional cast-coated paper sheet generally exhibits a high gloss when the mirror-finished surface of the cast-coater drum is copied by the film-forming material, for example, a binder, contained in a pigment-containing composition from which the coating layer is formed. However, the film-forming material contained in the coating layer causes the porosity of the coating layer to be decreased or lost, and the ink-absorption of the coating layer when an ink jet recording procedure is applied thereof is significantly reduced. To improve the ink-absorption of the coating layer, it is important that a porous structure is formed in the cast-coating layer to cause the resultant coating layer to exhibit an enhanced ink-absorbing property. For this effect, it is necessary to decrease the film-forming property of the recording stratum. However, the decrease in the content of the film-forming material in the recording stratum creates a such a problem that the white sheet gloss of the resultant recording stratum decreases. As mentioned above, it was very difficult to simultaneously keep both the surface gloss and the ink jet recording property of the cast-coating layer at satisfactory levels.

As means for solving the above-mentioned problem, Japanese Unexamined Patent Publication No. 7-89,220 discloses that a cast-coated paper sheet having both excellent gloss and ink-absorbing property and thus useful for ink jet recording system can be produced by the steps of coating a coating liquid comprising, as a principal component, a composition of a copolymer having a gloss-transition temperature of 40° C. or more on a paper sheet having a recording stratum comprising as principal components, a pigment and a binder, to form a coating layer for casting; and while the coating layer is kept in a wetted condition, bringing the wetted coating layer into contact with a heated casting surface of a casting drum under pressure, and then drying the coating layer to impart a high smoothness to the casting layer surface. Further, Japanese Unexamined Patent Publications No. 2-274,587 and No. 10-250,218 disclose a cast-coated recording stratum containing super-fine inorganic colloidal particles.

As mentioned above, currently, due to the development of high speed ink jet recording system, high accuracy and quality of the ink jet recorded images and full color recording system, on improvement in clarity, color density and storage durability of the recorded images is required of the ink jet recording material. For example, an ink jet recording material having a high recording quality and storage durability comparable to those of the silver-salt type photographic recording sheet is required. The above-mentioned prior art recording materials are insufficient to satisfy the above-mentioned requirements. Particularly, the conventional ink jet recording sheets having excellent gloss and a superior ink jet recording aptitude are not always satisfactory in resistance to fading of the printed ink images upon being exposed to sunlight or room light (for example, fluorescent lamp light). This problem has not yet been solved.

Regarding this problem, many attempts have been made to enhance the light resistance of the printed images by applying a light resistance-enhancing material to the ink jet recording sheets. For example, Japanese Unexamined Patent Publication No. 57-87,988 discloses an ink jet recording sheet containing, as at least one component, an ultraviolet ray-absorber. Japanese Unexamined Patent Publication No. 61-146,591 discloses an ink jet recording medium for recording colored images thereon with an aqueous ink containing a water-soluble dye, characterized in that the recording medium contains a hindered amine compound. Japanese Unexamined Patent Publication No. 4-201,594 discloses an ink jet recording material comprising a base material and an ink receiving layer formed on the base material and characterized in that the ink receiving layer contains super fine particulates of a transition metal compound. The recording materials mentioned above exhibit a certain light resistance-enhancing effect. However, they are insufficient in the ink-absorbing property and disadvantageous in that, with respect to the light resistance, the color balance of the faded images is unsatisfactory.

Japanese Unexamined Patent Publication No. 1-241,487 discloses an aqueous ink recording material having a coating formed on a base sheet surface and comprising 100 parts by weight of a resin binder comprising polyvinyl alcohol and a cationic, water-soluble resin and 0.1 to 30 parts by weight of a light-resistance-enhancing agent consisting of a compound having phenolic hydroxyl groups. This recording sheet is, however, unsatisfactory in the light resistance-enhancing effect thereof. Also, Japanese Unexamined Patent Publication No. 8-132,727 discloses an ink receiving layer comprising a metal complex of polyvinyl alcohol with calcium chloride, and Japanese Unexamined Patent Publication No. 9-290,556 discloses an ink jet recording sheet having a support and magnesium sulfate in a dry amount of 0.2 to 2.0 $g/m^2$ attached to the support. The recording sheets mentioned above exhibit a relatively good color balance of faded colored images, but the retention in color density of the images after fading is insufficient, and thus these recording sheets are not usable in practice.

Japanese Unexamined Patent Publication No. 10-193,776 discloses an ink jet recording material characterized by containing at least one member selected from image-stabilizing agents and ultraviolet ray absorbers, as a fade-preventing agent. However, it was found that certain fade-preventing agents degrade the ink-absorbing property of the recording material, and generally, the light resistance of the resultant recording materials is insufficient.

Japanese Unexamined Patent Publications No. 11-20,306 and No. 11-192,777 respectively disclose an ink jet recording sheet having an ink receiving layer containing, as a cross-linking agent, boric acid or borax, for the purpose of enhancing the water resistance of the ink receiving layer. This type of ink receiving layer is not satisfactory in both gloss and light resistance. Japanese Unexamined Patent Publication No. 2000-73,296 discloses a paper sheet having a porous layer containing borax and thus exhibiting a decreased change in form (curling form) due to change in the environmental conditions. However, this type of the paper sheet is unsatisfactory in the gloss thereof.

Japanese Unexamined Patent Publication No. 11-263,065 discloses a mat-type ink jet recording sheet provided with an ink receiving layer comprising cyclodextrin, and thus has excellent reproducibility of dots, resolving power of images, color-reproducibility of images, color-forming property of ink and pigment ink-applicability. Also, Japanese Unexamined Patent Publication No. 11-286,172 discloses a recording sheet provided with an ink receiving layer containing cyclodextrin which causes the light resistance of the recorded images to be enhanced. However, the recording sheets mentioned above are unsatisfactory in the gloss thereof.

SUMMARY OF THE INVENTION

An object of the present invention is to provide an ink jet recording material capable of recording thereon ink images having excellent color density, clarity, water-resistance and resistance to blotting, and a superior sharpness comparable to that of silver-salt photographic images, and having high surface smoothness and gloss.

Another object of the present invention is to provide an ink jet recording material having a high gloss and excellent ink jet recording properties, such as color density and clarity of ink images, and capable of recording ink images having a high light-resistance.

The above-mentioned objects can be attained by the ink jet recording material of the present invention which comprises:

a substrate and an image-recording stratum, located on at least one surface of the substrate, formed from at least one ink receiving layer and comprising a binder and a plurality of pigment particles dispersed in the binder, at least one ink receiving layer of the image-recording stratum comprising fine particles of at least one pigment selected from the group consisting of silica, aluminosilicate and α-, θ-, δ- and γ-aluminas and having an average particle size of 1 μm or less.

In the ink jet recording material of the present invention, preferably, at least one ink receiving layer of the image-recording stratum comprises fine particles of at least one silica compound selected from the group comprising silica and aluminosilicate and fine particles of at least one alumina compound selected from the group consisting of α-, θ-, δ- and γ-aluminas, and the fine particles of the silica compound and the fine particles of the alumina compound respectively have an average particle size of 1 μm or less.

In the ink jet recording material of the present invention, the fine particles of the alumina compounds are preferably in the form of secondary particles having an average secondary particle size of 500 nm or less, and consisting of a plurality of primary particles agglomerated with each other.

In the ink jet recording material of the present invention, the fine particles of the alumina compounds preferably have a BET specific area of 180 to 300 $m^2/g$.

In the ink jet recording material of the present invention, the fine particles of the alumina compounds preferably have a BET specific area of 50 to 300 $m^2/g$ and a pore volume of 0.2 to 1.0 ml/g.

In the ink jet recording material of the present invention, the fine particles of the alumina compounds are preferably selected from rod-shaped fine particles of δ- and γ-aluminas having an average particle length of 300 nm or less.

In the ink jet recording material of the present invention, the fine particles of the alumina compounds are preferably a product of hydrolysis of an aluminum alkoxide and have an $Al_2O_3$ content of 99.99% by weight or more.

In the ink jet recording material of the present invention, the fine particles of the alumina compounds are preferably fine particles of fumed alumina.

In the ink jet recording material of the present invention, the fine particles of at least one silica compound selected from the group consisting of silica and aluminosilicate contained in the ink image-recording layer are preferably formed from an aqueous slurry containing secondary particles having a average secondary particle size of 500 nm or less, each of the secondary particles consisting of an agglomerate of a plurality of primary particles having an average primary particle size of 3 to 40 nm with each other.

In the ink jet recording material of the present invention, the fine particles of silica are preferably fine particles of fumed silica.

In the ink jet recording material of the present invention, preferably, the fine silica compound particles and the fine alumina compound particles are respectively products obtained by subjecting aqueous dispersions containing particles of materials for the silica compounds and the alumina compounds, to pulverization procedures using pulverization and dispersion means under pressure selected from homogenizers under pressure, ultrasonic homogenizers and high speed stream-impacting homogenizers, to such an extent that the pulverization products have an average particle size of 1 μm or less.

In the ink jet recording material of the present invention, the image-recording stratum preferably has at least one ink receiving inside layer formed on the substrate and an ink receiving outermost layer formed on the outer surface of the ink receiving inside layer.

In the ink jet recording material of the present invention, the ink receiving inside layer of the image-recording stratum preferably contains fine particles of gel-method silica, and the ink receiving outermost layer preferably contains fine pigment particles of at least one member selected from the group consisting of the silica compounds and of the alumina compounds.

In the ink jet recording material of the present invention, the fine pigment particles contained in the ink receiving outermost layer are preferably secondary particles having an average secondary particle size of 800 nm or less and each consisting of a plurality of primary particles having an average primary particle size of 3 to 50 nm and agglomerated with each other to form secondary particles.

In the ink jet recording material of the present invention, the fine pigment particles contained in the ink receiving outermost layer are preferably fine fumed silica particles.

In the ink jet recording material of the present invention, the ink receiving outermost layer optionally further contains a cationic compound.

In the ink jet recording material of the present invention, the ink receiving outermost layer is preferably one formed by coating a coating liquid prepared by subjecting a mixture of the fine pigment particles and the cationic compound to a mechanical mix-dispersing procedure, on a substrate surface; and drying the coated coating liquid layer on the substrate surface.

In the ink jet recording material of the present invention, the fine silica particles contained in the ink receiving inside layers are preferably porous particles each having a plurality of fine pores having an average pore size of 20 nm or less.

In the ink jet recording material of the present invention, the substrate preferably exhibits a non-absorbing property for aqueous liquids.

In the ink jet recording material of the present invention, it is preferable that at least one ink receiving inside layer is formed from an aqueous coating liquid containing the fine pigment particles and a binder on the substrate; and the ink receiving outermost layer is formed from an aqueous coating liquid containing the fine pigment particles and binder on an outermost surface of the ink receiving inside layer, the ink receiving outermost layer being formed in such a manner that the aqueous coating liquid for the ink receiving outermost layer is coated on the aqueous coating liquid layer for the ink receiving inside layer adjacent to the ink receiving outermost layer, before the aqueous coating liquid layer is dried, and the both the aqueous coating liquid strata for the ink receiving outermost layer and the ink receiving inside layer are simultaneously dried, to thereby enhance the ink image-receiving property and the surface smoothness of the image-recording stratum.

In the ink jet recording material of the present invention, the substrate is preferably formed from an air-impermeable material.

In the ink jet recording material of the present invention, the air-impermeable material for the substrate is preferably selected from laminate paper sheets comprising a support sheet consisting of a paper sheet and at least one air-impermeable coating layer formed on at least one surface of the support sheet and comprising a polyolefin resin.

In the ink jet recording material of the present invention, the ink receiving outermost layer optionally further comprises a cationic compound.

In the ink jet recording material of the present invention, the ink receiving outermost layer preferably exhibits a 75° specular surface gloss of 30% or more.

In the ink jet recording material of the present invention, the ink receiving inside layer and the ink receiving outermost layer are preferably formed in such a manner that the coating procedure of the coating liquid for the ink receiving inside layer onto the substrate and the coating procedure of the coating liquid for the ink receiving outermost layer onto the adjacent ink receiving inside layer are substantially simultaneously carried out through a plurality of coating liquid-feeding slits of a multi-strata-coating apparatus.

In the ink jet recording material of the present invention, the simultaneous multi coating apparatus is preferably selected from multi coating slot die coaters, multi coating slide die coaters, and multi coating curtain die coaters.

In the ink jet recording material of the present invention, the ink receiving inside layer and the ink receiving outermost layer are preferably formed by such a manner that the coating procedure of the coating liquid for the ink receiving inside layer onto the substrate and the coating procedure of the coating liquid for the ink receiving outermost layer onto the adjacent ink receiving inside layer are successively carried out through a plurality of coating liquid-feeding slits of a plurality of coating apparatuses located independently from each other.

In the ink jet recording material of the present invention, the independent coating apparatuses are preferably selected from slot die coaters, slide die coaters and curtain die coaters each having a single coating liquid-feeding slit.

In the ink jet recording material of the present invention, the at least one ink receiving layer of the image-recording stratum comprising the binder and the fine pigment particle of at least one pigment selected from the group consisting of silica, aluminosilicate and α-, θ-, δ- and γ-aluminas and having an average particle size of 1 μm or less, optionally further comprises a light resistance-enhancing agent for images comprising at least one member selected from the group consisting of phenolic compounds, boric acid, borate salts and cyclodextrin compounds.

In the ink jet recording material of the present invention, it is preferable that the image-recording stratum comprises a plurality of ink receiving layers superposed on each other, that an ink receiving layer located outermost of the image-recording stratum comprises the fine pigment particles and the binder, and that at least one ink receiving layer in the image-recording layer contains an image light resistance-enhancing agent comprising at least one member selected from the group consisting of phenolic compounds, boric acid, borate salts and cyclodextrin compounds.

In the ink jet recording material of the present invention, the fine pigment particles contained in the ink receiving layer containing the image light resistance-enhancing agent are preferably in the form of secondary particles having an average secondary particle size of 1 μm or less and each consists of a plurality of primary particles having an average primary particle size of 3 to 40 nm agglomerated with each other.

In the ink jet recording material of the present invention, the phenolic compounds are preferably selected from the group consisting of hydroquinone compounds, pyrocatechol compounds and phenolsulfonic acid compounds.

In the ink jet recording material of the present invention, the cyclodextrin compounds are preferably selected from the group consisting of α-cyclodextrins,
β-cyclodextrins,
γ-cyclodextrins,
alkylated cyclodextrins,
hydroxyalkylated cyclodextrins, and
cation-modified cyclodextrins.

In the ink jet recording material of the present invention, the cyclodextrin compounds are preferably γ-cyclodextrins.

In the ink jet recording material of the present invention, the image light resistance-enhancing agent is preferably contained in the ink receiving layer by coating the ink receiving layer with a solution of the image light resistance-enhancing agent and drying the coated solution.

In the ink jet recording material of the present invention, the content of the image light resistance enhancing agent in the ink receiving layer is preferably 0.1 to 10 g/m$^2$.

In the ink jet recording material of the present invention, the fine pigment particles are preferably fine particles of at least one member selected from fumed silica, amorphous silica, aluminas and alumina hydrates.

In the ink jet recording material of the present invention, the fumed silica particles are preferably in the form of secondary particles having an average secondary particle size of 300 nm or less and each consisting of a plurality of primary particles having a primary particle size of 3 to 50 nm and agglomerated with each other.

In the ink jet recording material of the present invention, the ink receiving layer comprising the fine pigment particles and the binder optionally further comprises a cationic compound.

In the ink jet recording material of the present invention, the binder preferably comprises at least one member selected from the group consisting of water-soluble polymeric compounds, latices of copolymers of conjugated diene compounds, latices of vinyl copolymers, water-dispersible acrylic resins, water-dispersible polyester resins and water-dispersible polyurethane resins.

In the ink jet recording material of the present invention, the binder preferably comprises at least one member selected from the group consisting of polyvinyl alcohol, partially saponificated polyvinyl alcohols, acetacetylated polyvinyl alcohols, silyl-modified polyvinyl alcohols, cation-modified polyvinyl alcohols, and anion-modified polyvinyl alcohols.

In the ink jet recording material of the present invention, the substrate is preferably formed from a ink-nonabsorbing material.

In the ink jet recording material of the present invention, the surface of the image-recording stratum preferably has a 75° specular gloss of 30% or more.

DESCRIPTION OF THE PREFERRED EMBODIMENTS

Figure 1:
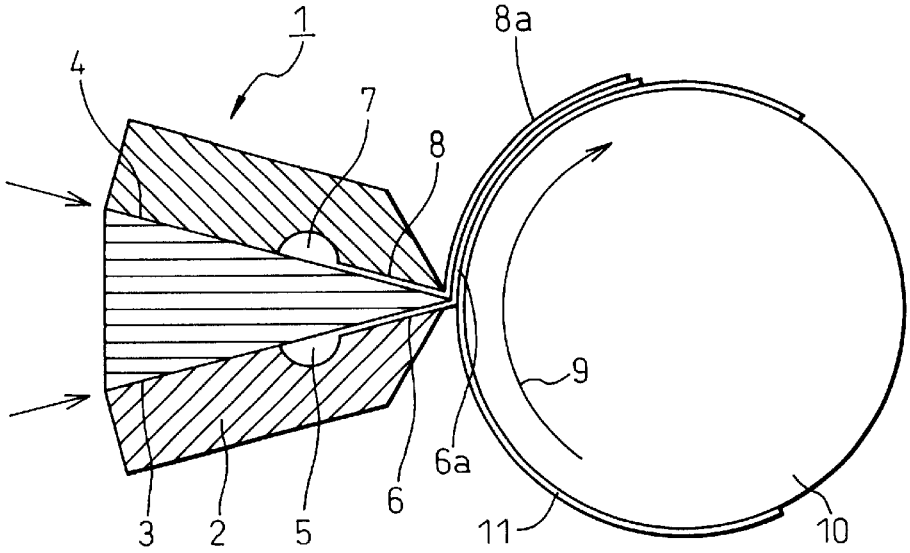
FIG. 1 shows an explanatory cross-sectional view of an embodiment of multi-coating slot die coaters for producing the ink jet recording material of the present invention.

The ink jet recording material of the present invention can record thereon ink images having high color density, clarity, water resistance, moisture resistance and resistance to blotting of the ink and has a high surface smoothness and a satisfactory gloss. Particularly, the ink images recorded on the ink jet recording material of the present invention are comparable in sharpness and clarity to the silver-salt type photographic images.

Generally, a recording stratum formed by coating a dispersion liquid containing pigment particles having an average particle size of 1 μm or more on a substrate has an unsatisfactory transparency and surface smoothness and thus it is difficult to produce a recording stratum capable of recording thereon ink images having a high color density, and having a high surface gloss, from the above-mentioned pigment dispersion liquid. However, the problem can be solved by forming a recording stratum containing fine particles of a specific pigment comprising at least one member selected from silica, alumninosilicate and α-, θ-, δ- and γ-aluminas on the substrate. Particularly, by using fine particles of at least one alumina compound selected from the group consisting of α-, θ-, δ- and γ-aluminas and having an average particle size of 1 μm or less, a recording stratum having a high gloss, a high smoothness and a high water resistance of printed images can be formed. Also, by employing a fine particles of at least one silica compound selected from the group consisting of silica and alumninosilicate, a recording stratum capable of recording thereon colored images having a bright color tone and a high clarity can be obtained. Particularly, a utilization of fine particles of at least one alumina compound selected from the group consisting of α-, θ-, δ- and γ-aluminas and having an average particle size of 1 μm or less, enables the resultant recording stratum having a high gloss and a high smoothness and capable of recording ink images having a high water resistant to be formed. Also, use of fine particles of at least one silica compound selected from the group consisting of silica and aluminosilicate enables a resultant recording stratum capable of enhancing the color-forming property of the ink and of recording ink images having a high sharpness and brightness to be formed. Therefore, in the recording stratum of the ink jet recording material of the present invention, at least one ink receiving layer contains both fine particles of at least one silica compound selected from silica and alumninosilicate and fine particles of at least one alumnia compound selected from α-, θ-, δ- and γ-aluminas, the silica compound fine particles and the alumina compound fine particles respectively have an average particle size of 1 μm or less.

With respect to the alumnina compound, it is known from, for example, Electrochemistry, vol. 28, page 302, FUNAKI AND SHIMIZU, "Alumina Hydrate and Alumnina", the section of "Examples of thermal changes of alumina hydrates", that when aluminum hydroxide; for example, gibbsite, Bayerite or boehmite is heated, the crystal form of the alumina compound is changed in the manner of $\chi \rightarrow \kappa \rightarrow \alpha$, $\gamma \rightarrow \delta \rightarrow \theta \rightarrow \alpha$, $\eta \rightarrow \theta \rightarrow \alpha$, $\rho \rightarrow \eta \rightarrow \theta \rightarrow \alpha$ or $\gamma \rightarrow \theta \rightarrow \alpha$, through various intermediate forms and finally to α-alumina form; while increasing the particle size thereof. Also, when an aluminum salt, for example, aluminum chloride, aluminum sulfate, or aluminum nitrate is thermally decomposed, the amorphous alumina can be changed to α-alumina through intermediate γ-, δ- or θ-alumina. This change (transition) is disclosed, for example, in "MINERALOGY JOURNAL" vol. 19, No. 1, pages 21 and 41. The alumina compound contained in the ink jet recording material of the present invention is selected from α-, θ-, δ- and γ-aluminas and has an average particle size of 1 μm or less. There is no limitation to the particle form of the fine alumnina compound particles. In view of the gloss and the smoothness of the resultant recording stratum, it is preferable that the recording stratum is formed from an aqueous slurry of secondary particles of the alumnina compound having a particle size of 500 nm or less. Preferably, the fine particles of the alumnina compounds usable for the present invention has a BET specific area of 180 to 300 $m^2/g$, more preferably 190 to 280 $m^2/g$, still more preferably 190 to −250 $m^2/g$. If the BET specific area of the alumina compound fine particles is less than 180 $m^2/g$, the resultant color density of the ink images recorded on the recording stratum may be insufficient, and if the BET specific area is more than 300 $m^2/g$, the resultant recording stratum may exhibit an insufficient ink absorption. Also, in the alumina compound fine particles, preferably, the BET specific area is in the range of from 50 to 300 $m^2/g$, and the pore volume is in the range of from 0.2 to 1.0 ml/g, more preferably, the BET specific area is from 100 to 280 $m^2/g$ and the pore volume is from 0.3 to 0.9 ml/g, still more preferably the BET specific area is from 150 to 250 $m^2/g$ and the pore volume is from 0.4 to 0.8 ml/g. In this case, when the BET specific area of the alumina compound fine particles is less than 50 $m^2/g$, the color density of the recorded ink images on the resultant recording stratum may be extremely low, and if the BET specific area is more than 300 $m^2/g$, the resultant recording stratum may exhibit an insufficient ink absorption. Also, if the pore volume is less than 0.2 ml/g, the resultant recording stratum may exhibit an insufficient ink absorption, and if the pore volume is more than 1.0 ml/g, the resultant recording stratum may have an insufficient transparency, a significantly low color density of the recorded ink images, and a very unsatisfactory gloss. The fine particles of the alumina compounds usable for the present invention are more preferably selected from rod-shaped fine particles of δ- and γ-aluminas, and the average particle length of the rod-shaped particles is preferably 300 nm or less, more preferably 100 nm or less. The above-mentioned secondary particles of the alumnina compounds exhibit a good dispersing property in an aqueous slurry thereof. Particularly, the use of fine alumnina compound particles produced by a hydrolysis of an aluminum alkoxide and having an $Al_2O_3$ content of 99.99% or more, or fine fumed alumina particles, enables a recording stratum having a high gloss and a high smoothness to be realized. The fumed alumina is produced by hydrolyzing a starting material consisting of aluminum tetrachloride in the presence of water generated by an oxygen-hydrogen reaction.

As long as the silica compound is in the form of fine particles having an average particle size of 1 μm, the silica compound fine particles can be used for the present invention without limitation in the type and form of the particles.

The silica particles are generally produced by the following methods.

(1) Combustion method (for example, REOLOSIL (trademark) made by TOKUYAMA, AEROSIL (trademark) made by DEGUSSA, NIHON AEROSIL, CAB-O-SIL (trademark) made by CABOT), (2) Heating method (for example, FRANSIL (trademark) made by FRANSOL), and ARC SILICA (made by PPG IND.), (3) Aerogel method (for example, SANTOCEL (trademark) made by MONSANT), (4) Flame spraying method (for example, EXCELICA (trademark) made by TOKUYAMA), (5) Precipitation method (for example, TOKUSIL (trademark) made by TOKUYMA, SOLEX (trademark) made by TOKUYAMA, HI-SIL (trademark) made by PPG IND., ULTRASIL (trademark) made by DEGUSSA, NIPSIL (trademark) made by NIHON SILICA KOGYO, CARPLEX (trademark) made by SHIONOGI SEIYAKU, FINESIL (trademark) made by TOKUYAMA, and MIZUKASIL (trademark) made by MIZUSAWA KAGAKU-KOGYO), (6) Gel method (for example, SYLOID (trademark) made by GRACE, and SYLYCIA (trademark) made by FUJI-SYLYCIA KAGAKU), (7) Sol method (for example, SNOWTEX (trademark), made by NISSAN KAGAKU), and (8) Sol.Gel method (for example, spherical silica, made by TOKUYAMA).

The dry methods (fumed silica) include the methods (1) and (2), and the wet methods include the methods (5) to (8). They are different in the starting materials and the procedures from each other, and in accordance with the methods, the resultant silicas are different in properties from each other.

The silica of the combustion method is produced by a combustion of silicon tetrachloride with oxygen and hydrogen. The silicas of the wet methods are produced by using silicon dioxide ($SiO_2$), mainly, silica sand, as a starting material. The amorphous silica of the gel method is produced, for example, by the procedures of producing a silicic acid sol by mixing sodium silicate produced from a starting material consisting of a high purity silica sand with sulfuric acid; allowing the silicic acid to gradually polymerize, and to form primary particles, and the primary particles to three-dimensionally agglomerate with each other to form agglomerates, and finally to form a gel; and finely pulverizing the silica gel to provide fine silica particles. Namely, in the gel method, the reaction and polymerization are effected under, and acidic condition; the resultant polymerization product is left to stand until the resultant product is converted to a gel in a sherbet-like state; and the gel is washed with water and dried to provide amorphous silica. In the gel method silica particles, the size of fine pores formed between the primary particles is small, but in the precipitation method silica particles, the fine pores size is large. The precipitation method amorphous silica is produced by carrying out the reaction and polymerization under an alkaline condition; allowing the resultant product to precipitate, and drying the resultant precipitate particles.

To obtain a recording stratum having a high gloss and a high color density of recorded ink images, an aqueous slurry of secondary particles of silica having an average secondary particle size of 500 nm or less and an average primary particle size of 3 to 40 nm is preferably employed and more preferably, an aqueous slurry of fumed silica particles is employed. By dispersing the silica secondary particles in water to form an aqueous slurry, the agglomeration of the silica particles can be prevented and thus an increase in the size of the silica particles can be prevented.

In the preparation of the above-mentioned pigment particle slurry, an aqueous medium is usually employed in consideration of the coating property of the resultant slurry. An organic solvent may be, however, employed as a medium of the pigment particle slurry. Also, in the production of the fumed silica, the starting materials can be purified to a high extent and contamination of the materials during the production procedures can be prevented, and thus a high degree of purity of the silica particles can be obtained whereby the transparency of the resultant recording stratum and the color density of the recorded images can be enhanced.

In the ink jet recording material of the present invention, the fine particles of the silica compound and the fine particles of the alumina compound are contained altogether in the recording stratum. In the case where the recording stratum consists of a plurality of ink receiving layers, the fine silica compound particles and the fine alumnina compound particles may be contained altogether in one or more the same ink receiving layers or in two or more ink receiving layers different from each other. Also, the recording stratum may comprise one or more ink receiving layers containing the fine silica particles and the fine alumina particles altogether and one or more ink receiving layers each containing the fine silica particles or the fine alumina particles.

In the case where the recording stratum consists of a single ink recording layer containing both the fine silica particles and the fine alumina particles, there is no specific limitation to the mixing ratio of the silica compound to the alumina compound. Usually, the alumina compounds to the silica compound ratio is preferably in the range of from 95/5 to 5/95, more preferably from 20/80 to 80/20.

In the case where the recording stratum consists of two or more ink receiving layers, the recording stratum may be constituted from one or more ink receiving layers containing the alumina compound alone and one or more ink receiving layers containing the silica compound alone.

To disperse and pulverize the silica compound or the alumina compound, a homomixier, an ultrasonic homogenizer, a pressurizing homozenizer, a nanomizer a high speed revolution mill, a roller mill, a container-driving medium mill, a medium agitation mill, a jet mill, or a sand grinder. To disperse or pulverize the silica or alumina compound with an enhanced efficiency, a pressurizing type dispersing system is preferably employed.

In the present invention, the pressurizing type dispersing method is defined as a method in which a slurry mixture of material particles is continuously passed through an orifice under pressure to pulverize the particles under the high pressure. The treatment pressure is preferably $19.6\times10^6$ to $343.2\times10^6$ Pa (200–3500 hgf/cm$^2$), more preferably from $49.0\times10^6$ to $245.3\times10^6$ Pa (500 to 2500 hgf/cm$^2$), still more preferably from $98.1\times10^6$ to $196.2\times10^6$ Pa (1000 to 2000 hgf/cm$^2$). The silica and alumina compounds can be dispersed and pulverized by the high pressure pulverization treatment with a high efficiency. Further, it is more preferably that two streams of the slurry mixture passed though the orifice under the high pressure are countercurrently collided against each other to further disperse and pulverize the silica and alumnina compound particles. In the countercurrent collision method, a slurry mixture of the silica or alumina particles is introduced to an inlet side under pressure, the introduced stream of the slurry mixture is divided into two streams of the slurry mixture passing through two passages, the passages are connected to orifices having a small inside diameter, to accelerate the flow speed of the slurry mixture, and the two streams of the slurry mixture passed through the orifices are countercurrently collided against each other at the accelerated flow speed, to pulverize the particles of the silica or alumina compound collided against each other.

The parts of the high pressure pulverization system in which the slurry mixture streams are accelerated in flow speed or collided against each other, are preferably formed from diamond to control the abrasion of the parts. The high pressure pulverization machine is preferably selected from pressurizing homogenizers, ultrasonic homogenizers, microfultizers and nanomizers, particularly, as a high speed stream-collosion type homogenizer, a microfultizer or nanomizer is more preferably employed.

Generally, the ink for the ink jet printing contains an anionic dye. However, since the silica compound is also anionic, the resultant ink images printed on the silica compound-containing ink receiving layer exhibit unsatisfactory moisture resistance and water resistance. To enhance the moisture resistance and the water resistance of the anionic dye images, a cationic compound is contained in the recording stratum. The fine particles of the alumina compound are cationic. Preferably, the recording stratum further contains, in addition to the alumina compound particles, a cationic compound. The cationic compound usable for the present invention is preferably selected from polyalkylene polyamines, for example, polyethyleneamine and polypropylenepolyamine, derivatives thereof; cationic resins, for example, acrylic resins having tertiary amino groups and/or quaternary ammonium salt groups, and dialkylamine polymers; and cationic inorganic salts of aluminum and calcium. There is no specific limitation to the molecular weight of the cationic compounds. Preferably, the molecular weight of the cationic compounds is 60,000 or more or 10,000 or less. If the molecular weight of the cationic compound is more than 10,000 but less than 60,000, the resultant cationic compound molecules easily enter into the pores formed between the fine silica particles, and thus the pores for receiving the ink are filled with the cationic compound, and the resultant recording stratum or ink receiving layer exhibits a poor ink-absorption. There is no specific upper limit to the molecular weight of the cationic compound. However, in consideration of ease of handling, the molecular weight in preferably not more than about 500,000.

Where the cationic compound is contained together with the pigment particles in the recording stratum, the cationic compound is preferably employed in an amount of 1 to 30 parts by weight, more preferably 3 to 25 parts by weight, per 100 parts by weight of the pigment.

There is no limitation to the method of employing the cationic compound in the recording stratum. For example, the cationic compound is employed in a mixture with a pigment, or the cationic compound is absorbed in the pigment particles and the resultant pigment/cationic compound complex is employed, or the cationic compound alone is contained in the recording stratum. When the silica compound which is anionic, is mixed with a cationic compound, an agglomerate is formed. The agglomerate may be pulverized into particles having an average particle size of 1 $\mu$m or less, and the resultant particles may be employed for the ink jet recording material of the present invention.

The average particle size and length of the alumina compound particles usable for the present invention are measured by the following method.

The particles of δ- and γ-aluminas are in the crystal form of a rod or a needle, and thus, the size of the particles is indicated by the length of the particles.

The average particle size of the silica compound particles and the alumina particles and the average length of the rod-formed alumina particles are measured in such a manner that the particles are dispersed in water to provide an aqueous dispersion of the particles in a content of 5% by weight, the particle dispersion is subjected to a dispersing treatment by a homomixer at a revolution rate of 50 rps (3000 rpm) for 5 minutes and, immediately after the dispersing procedure, the resultant dispersion is coated on a base plate and the resultant sample is subjected to an electron-microscopic observation using a scanning or transmission type electron microscope, to determine the particle size or length, in accordance with the procedures shown in "FINE PARTICLE HANDBOOK", ASAKURA SHOTEN, page 52. The measurements are repeated for ten portions of the sample, to measure the particle sizes or lengths of 500 particles in which portion of the sample, and an average particle size or length is calculated from the resultant data. The average particle size is defined as an average value of the sizes measured at at-random portions of the particles, and the average length is defined as an average value of the measured largest lengths of the individual particles.

In the ink jet recording material of the present invention, the recording stratum preferably comprises at least one ink receiving inside layer formed on the substrate and an ink receiving outermost layer laminated on the outer surface of the ink receiving inside layer.

In this case, preferably, the ink receiving inside layer comprises fine silica particles produced by a gel method, and the ink receiving outermost layer comprises fine particles of at least one pigment selected from silica compound pigments and alumina compound pigments.

The fine pigment particles contained in the ink receiving outermost layer are preferably secondary particles consisting of agglomerates each consisting of a plurality of primary particles having an average primary particle size of 3 to 40 nm and having an average secondary particle size of 800 nm or less.

The above-mentioned fine pigment particles contained in the ink receiving outermost layer are preferably fumed silica particles.

When at least one layer of the ink receiving inside layers contains fine silica particles, particularly gel method silica particles, the resultant stratum can exhibit an enhanced moisture resistance and an improved resistance to blotting of the recorded ink images, and thus the color tone of the recorded ink images can be stabilized within a short time. The reasons for the improvement in the resistance to blotting of the ink images are not fully clear. It is assumed, however, that fine pores formed between the primary particles of the gel method silica particle have a size small enough to prevent the movement of the dye contained in the ink and fixed in the fine pores. Also, reasons for the phenomenon that the color tone of the recorded ink images is stabilize within a short time are assumed to be that the dye and the solvent in the ink are rapidly separated from each other in the gel method silica particles and the fine pores between the primary particles of the silica particles have a high holding capacity for the separated solvent. There is no limitation to the size of the fine pores and, usually, the fine pore size is, for example, 20 nm or less and preferably 15 nm or less.

In view of the gloss of the recording stratum and the color density of the recorded images, the average secondary particle size of the gel method silica particles is preferably 1 $\mu$m or less, more preferably 800 nm or less, still more preferably 500 nm or less. The primary particles from which the gel method silica secondary particles are constituted preferably have an average primary particle size of 3 to 50 nm.

To obtain a color density of the recorded ink images similar to that of the silver salt type photographic images, the pigment particles having a particle size of 1 $\mu$m or less and contained in the ink receiving outermost layer are preferably selected from fine particles of amorphous silica, aluminas including hydrated aluminas and aluminosilicate, having an average secondary particle size of 800 nm or less, more preferably 500 nm or less, still more preferably 300 nm or less, further preferably 200 nm or less. There is no lower limit to the average secondary particle size. Usually, the average secondary particle size is preferably 10 nm or more. The average primary particle size of the primary particles from which the secondary particles of the above-mentioned pigments are constituted is preferably in the range of from 3 to 40 nm.

Particularly, when as the fine particles to be contained in the ink receiving outermost layer, fumed silica particles having a high degree of purity are employed, the fumed silica is preferably selected from combustion method silica and heating method silica, particularly, the combustion method silica is preferably employed to obtain an ink receiving outermost layer having a high gloss.

The fumed silica particles are advantageous not only in that super fine particles can be obtained by applying a relatively low mechanical power, but also in that the refractive index of the fumed silica is low and the transparency thereof is high, and thus the resultant ink receiving outermost layer can exhibit a high gloss and a high color density of the recorded images. Also, the fumed silica exhibits highly thixatropic properties and thus, can form an agglomerate under a static condition under which no external force is applied thereto. The average particle size of the fumed silica particles usable for the present invention is measured by a method such that an aqueous dispersion of 5% by weight of fumed silica particles (when the silica is in the state of an aqueous slurry, the content of the silica in the slurry is adjusted to 5% by weight by diluting the slurry with water) is stirred and dispersed by a homomixer at a revolution rate of 33.3 rps (2000 rpm) for 10 minutes, and then subjected to a pulverizing treatment using a pressurizing homogenizer (model: GM-2, made by SMT K.K.) under a pressure of 39.2 MPa (400 kgf/cm$^2$), and the particle size of the resultant particles in the dispersed state is measured by a transmission type microscope.

In the ink jet recording material of the present invention, to enhance the water resistance of the recorded ink images, nonionic pigment particles or anionic pigment particles (for example, silica particles) may be cation-modified with an alumina compound or a silane-coupling agent (for example, n-2-aminoethyl-3-aminopropyltriethoxysilane, etc.), and the cation-modified pigment particles may be employed for the recording stratum.

Also, the recording stratum may contain a cationic compound. The cationic compound usable for the present invention include, for example, polyalkylenepolyamines, for example, polyethyleneamine and polypropylenepolyamine, and derivatives thereof; and cationic resins, for example, cationic acrylic resins having tertiary amino groups or quaternary ammonium salt groups and cationic diallylamine polymers. The cationic resins are preferably contained in an amount of 1 to 40 parts by weight, more preferably 3 to 25 parts by weight, per 100 parts by weight of the pigment, in the recording stratum.

Generally, the silica particles have silanol groups distributed in the surface portions of the particles and thus are electrically negative and when mixed with a cationic compound, the silica particles are reacted with the cationic compound and agglomerated with each other. The resultant agglomerates having an average particle size more than 1 $\mu$m can be fully dispersed by applying a weak mechanical force thereto by using, for example, a homomixer. When the aqueous slurry of silica particles having an average particle size of 1 $\mu$m or less is used, a strong pulverizing force is preferably applied thereto, to prepare a desirable coating liquid.

The strong mechanical pulverizers include high revolution homomixers, ultrasonic homogenizers, pressurizing homogenizers, Ultimaizer (trademark), Nanomizer (trademark), high revolution mills, roller mills, container-driving medium mills, medium agitation mills, jet mills, sand grinders and Clearmix (trademark). To pulverize and disperse the silica agglomerates with a high efficiency, a pressurizing pulverization is preferably employed.

In the recording stratum of the present invention, an ink receiving layer free from the above-mentioned silica compound fine particles and alumina compound fine particles may contain pigment particles other than the silica and alumina compound particles. The other type pigment may be selected from amorphous silica (including cation-modified silica, for example, alumina-modified silica), kaolin, clay, calcined clay, zinc oxide, tin oxides, magnesium sulfate, aluminum hydroxide, alumina and alumina hydrates (including $\chi$-, $\kappa$-, $\gamma$-, $\delta$-, $\theta$-, $\eta$-, $\rho$-, pseudo $\gamma$- and $\alpha$-crystalline aluminas, and boehmite-structured and pseudoboehmite-structured crystalline aluminas), calcium carbonate, satin white, aluminum silicate, smectite, zeolite, magnesium silicate, magnesium carbonate, magnesium oxide, diatomaceous earth, polystyrene polymeric pigments, urea resin pigments and benzoguanamine resin pigments. In the present invention, the other type pigment is preferably selected from amorphous silica (including cation (for example, alumina)-modified silica), alumninosilicate in which silica is coated with alumina), aluminas, alumina hydrates (including $\chi$, $\kappa$, $\gamma$, $\delta$, $\theta$, $\eta$, $\rho$, pseudo $\gamma$- and $\alpha$-aluminas, and boehmite-structured and pseudoboehmite-structured crystalline aluminas) and calcium carbonate, more preferably from the silica compounds and alumina compounds other than the specific silica and alumina compounds for the present invention.

In the ink jet recording material of the present invention, the substrate may be a liquid-absorbing substrate or a liquid-non-absorbing substrate, the liquid-absorbing substrate is selected from, for example, woodfree paper sheets (acid paper sheets, neutral paper sheets, art paper sheets, coated paper sheets, cast-coated paper sheets, kraft paper sheets, and impregnated paper sheets. To obtain a high smoothness, and silver salt type photographic sheet-like hand, (particularly whiteness and touch) of the recording sheet, paper sheets having a high smoothness and a high density for the photographic sheets or RC sheets is preferably employed as a substrate for the present invention.

The paper sheet usable for the liquid-absorbing substrate will be explained in detail below. The paper sheet for the substrate is mainly formed from a wood pulp and optionally a pigment. The wood pulp include mechanical pulps, chemical pulps and re-used paper pulps. To control the mechanical strength and paper-forming property of the pulp, the degree of beating for the pulp is controlled by a pulping machine. The degree of beating is represented by a Canadian Standard freeness (CSF) in accordance with JIS P 8121. There is no limitation to the pulp freeness. Usually, a pulp having a Canadian Standard freeness of 250 to 550 ml is used for the substrate.

The paper sheet for the substrate optionally contains a pigment to control the ink-absorbing property of the substrate. For the pigment for the substrate, calcium carbonate, sintered kaolin, silica, and titanium dioxide can be employed. When the above-mentioned pigments are employed, the content of the pigments in the paper sheet is preferably 1 to 20% by weight. If the pigment content is too high, the resultant paper sheet may exhibit an insufficient mechanical strength. The paper sheet optionally contains an additive comprising at least one member selected from sizing agents, fixing agents, sheet strength-enhancing agents, cationic agents, yield-enhancing agents, dyes and fluorescent brightening agents. In the size-press step of the paper-forming procedure, the surface strength and the sizing degree of the paper sheet can be controlled by coating or impregnating the paper sheet with starch, polyvinyl alcohol and/or a cationic resin. The degree of sizing of the paper sheet is preferably about 1 to about 200 seconds. If the sizing degree of the paper sheet is too low, an operational problem, for example, formation of wrinkles, may occur during the coating or impregnating step. If it is too high, the resultant paper sheet for the substrate may exhibit too low an ink-absorbing property, and thus significant curling or cockling of the paper sheet may occur when the ink jet printing operation is applied to the resultant recording sheet. There is no limitation to the basis weight of the paper sheet for the substrate.

Usually, the substrate paper sheet preferably has a basis weight of 20 to 400 g/m$^2$, a thickness of 20 to 400 $\mu$m and a bulk density of 0.6 to 1.2.

For the liquid-non-absorbing substrate sheet for the ink jet recording material of the present invention, transparent and opaque viscose sheet (cellophane sheet (trademark)), plastic sheets or films, for example, sheets and films of polyethylene, polypropylene, soft polyvinyl chloride, polyester, polycarbonate, and polystyrene; water-absorbing and water-non-absorbing sheets or films of the plastic polymers as mentioned above; resin films, synthetic paper sheets, and resin-coated sheets prepared by coating a base sheet comprising, as a main material, a pulp, for example, woodfree paper sheets, neutral paper sheets, support sheets for photographic sheets, art paper sheets, coated paper sheets, cast-coated paper sheets, kraft paper sheets and impregnated paper sheets, with a water-non-absorbing resin. The coating resin may be selected from polyethylene resins, polypropylene resins, polyester resins, polyolefin resins, polycarbonate resins, and resins comprising, as a principal component, a mixture of two or more of the above-mentioned resins. The polyethylene resins include low density polyethylene resins, high density polyehtylene resins, and straight linear low density polyethylene resins. The polyester resins include polyethylene terephthalate resins, polybutylene terephthalate resins and bio-degradable polyester resins.

For the purpose of enhancing the whiteness and/or the opacifying effect of the substrate, the substrate sheets, particularly the plastic polymer sheets or films and the base sheet or coating resin layer of the resin-coated sheets, may contain a white pigment, preferably, a titanium dioxide pigment, a calcium carbonate pigment, a synthetic silica pigment, or a mixture of two or more of the above-mentioned pigments. The titanium dioxide pigments are most preferable. Other pigments which may be contained in the substrate are synthetic silica, zinc oxide, talc and kaolin which are well known and publicly used as white pigments.

For the purpose of preventing the cockling of the recording material and of enhancing the surface smoothness and gloss, as a substrate, a liquid-non-absorbing substrate, particularly a plastic polymer film having a high smoothness, is preferably employed. The plastic polymer film is, however, disadvantageous in that it is expensive and is difficult to obtain a recording material having a silver-salt photographic sheet-like properties (particularly a high whiteness and touch). Thus, in place of the plastic polymer film, a resin-coated paper sheet having a high smoothness and produced by coating a woodfree paper sheet, a support paper sheet for photographic sheet, an art paper sheet, a coated paper sheet or cast-coated paper sheet which comprises, as a principal component, a pulp and has a high smoothness, with a coating resin comprising a polyethylene resin, polypropylene resin, a polyester resin, another polyolefin resin, a polycarbonate resin or a mixed resin comprising, as a main component, a mixture of two or more of the above-mentioned resins, is preferably employed.

Particularly, a high smoothness resin-coated paper sheet produced by coating a support paper sheet for a photographic sheet with a polyethylene resin or another polyolefin resin is preferably used as a substrate sheet for the ink jet recording material of the present invention. For the purpose of obtaining the silver salt photograph-like hand (particularly touch) and/or of controlling the curling of the recording material, the recording material preferably has a coating layer comprising a polyethylene resin or another polyolefin resin formed on a back surface opposite to the recording surface of the recording material.

There is no limitation to the thickness of the coating layer of the substrate. Usually, the coating layer thickness is preferably in the range of from 4 to 100 $\mu$m, more preferably from 5 to 50 $\mu$m, still more preferably from 7 to 35 $\mu$m. When the coating layer is too thin, the coating effect may be insufficient, and when the coating layer is too thick, the hand of the resultant recording material may be unsatisfactory. The thickness of the coating layer on the front or back surface of the recording material and the type of the coating resin may be established in consideration of the curling property of the resultant recording material. The coating resin may contain a white pigment, preferably a titanium dioxide pigment, a calcium carbonate pigment, a synthetic silica pigment or a mixture thereof. More preferably, the titanium dioxide pigment is employed for the coating resin.

When a liquid-non-absorbing sheet is used as a substrate of the ink jet recording material of the present invention, a surface of the substrate sheet on which surface side the recording stratum is formed, may be previously subjected to an adhesion treatment or a adhesive treatment, for the purpose of enhancing the close adhesion between the substrate and the recording stratum. Particularly, when a resin-coated paper sheet is used as a non-liquid-absorbing substrate sheet, it is preferable that a corona discharge treatment is applied to a surface of the resin-coating layer, or an undercoat layer comprising gelatin or polyvinyl alcohol is formed between the base paper sheet and the resin coating layer.

For the purpose of enhancing the transportation property, anti-static property and anti-blocking property of the recording material, the back surface of the recording material may be treated. The back surface treatment includes, for example, chemical treatments with an antistatic agent or an anti-blocking agent. Also, the an additional coating layer or another structure may be formed on the back surface of the substrate sheet.

There is no limitation to the smoothness of the substrate sheet. Usually, to obtain a high gloss and a high smoothness, the smoothness of the substrate sheet is preferably 300 seconds or more, determined in accordance with a OKEN method, J. TAPPI No. 5. Also, there is no limitation to the opaqueness of the substrate sheet. Usually, to obtain silver salt photographic sheet-like properties, particularly whiteness on the naked eye, the opaqueness of the substrate sheet is preferably 85% or more, more preferably 93% or more, determined in accordance with JIS P 8138.

The recording stratum of the ink jet recording material of the present invention contains a binder for bonding the fine particles of the pigment to each other and to the substrate sheet. The binder comprises at least one member selected from water-soluble polymers, for example, polyvinyl alcohol, modified polyvinyl alcohols, for example, cationic polyvinyl alcohol and silyl polyvinyl alcohol; casein, soybean protein, synthetic proteins, starch, cellulose derivatives, for example, carboxymethyl-cellulose and methylcellulose; water-dispersible polymers, for example, conjugated diene polymer latices, for example, styrene-butadiene-copolymer latices and methyl methacrylate-butadience copolymer latices, vinyl copolymer latices, for example, acrylic polymer latices and styrene-vinyl acetate copolymer latices, which are well known and popularly employed in the coated paper sheet field. These binders may be used alone or in a mixture of two or more thereof. In the present invention, for the purpose of enhancing the ink absorbing property and the water resistance of the recording stratum, the water-soluble polymers such as polyvinyl alcohol compounds are preferably employed.

There is a specific limitation to the solid weight ratio of the pigment to the binder contained in each of the ink receiving inside layers and the ink receiving outermost layer. Usually, the solid weight ratio is preferably adjusted within the range of from 100/2 to 100/200, more preferably from 100/5 to 100/100. If the content of the binder is too high, the fine pores formed between the pigment particles may have too small a size, and thus the ink absorbing rate of the resultant ink receiving layer may be too low. Also, if it is too low, the resultant ink receiving layer may exhibit a poor resistance to cracking of the layer.

Particularly, in the alumina compound-containing recording stratum or in each of the ink receiving inside layers and the ink receiving outermost layer included in the recording stratum, the content of the water-soluble polymer contained in each of the stratum or the layers is preferably 20 parts by weight or less per 100 parts by weight of the pigment. Further, in the ink receiving layer containing a pigment consisting of the alumina compounds alone, the content of the water-soluble polymer is preferably 10 parts by weight or less per 100 parts by weight of the pigment. The alumina compound pigment contributes to preventing or restructing the cracking of the ink receiving layers, and when the content of the alumina compound pigment is limited to 10 parts by weight or less, the ink-absorbing rate of the ink receiving layer is enhanced.

The coating amount of the recording stratum is not limited to a specific level. Usually, the recording stratum is preferably formed in a total amount of 1 to 100 g/m$^2$, more preferably 2 to 50 g/m$^2$. When the total amount of the recording stratum is less than 1 g/m$^2$, a uniform stratum having a high smoothness may be difficult to form. Also, the total amount of the recording stratum is more than 100 g/m$^2$, the resultant stratum may exhibit a poor resistance to cracking.

The coaters usable for the formation of the recording stratum may be selected from various conventional types of coaters, for example, blade coaters, air knife coaters, roll coaters, bar coaters, gravure coaters, rod blade coaters, lip coaters, die coaters and curtain coaters.

In an embodiment of the ink jet recording material of the present invention, at least one ink receiving inside layer is formed on a surface of a substrate from an aqueous coating liquid containing the above-mentioned fine pigment particles and the binder, an ink receiving outermost layer is formed on the outer surface of the ink receiving inside layer from an aqueous coating liquid containing the above-mentioned fine pigment particles and the binder.

Preferably, the ink receiving outermost layer is formed by coating the aqueous coating liquid for the outermost layer on the aqueous coating liquid layer for the ink receiving inside layer before the aqueous coating liquid layer for the inside layer is dried, and by simultaneously drying both the aqueous coating liquid layers for the inside layer and the outermost layer. In this case, the resultant recording stratum exhibit improved ink image-receiving property and surface smoothness.

When an ink jet recording procedure is applied to a recording sheet having a porous recording stratum comprising, as principal components, a pigment and a binder and formed on a substrate sheet, and the substrate sheet is a paper sheet having a high water-absorption, the applied ink easily penetrates into the substrate paper sheet to cause a cockling phenomenon to occur on the recording sheet. When a non-water-absorbing sheet or low-water-absorbing sheet is used as a substrate sheet, the cockling phenomenon can be prevented. However, in order that a sufficient absorption of the ink is attained only by the recording stratum, the recording stratum must be formed in a large coating amount, for example, 15 g/m$^2$ or more. When such a thick recording stratum is formed by only one coating operation, the resultant recording stratum may be uneven in the thickness thereof, may exhibit an insufficient resistance to cracking and may have an unsatisfactory appearance and the quality of the printed images on the uneven recording stratum may be unsatisfactory. Also, for the purpose of obtaining both a high gloss and a high ink absorbing property, the recording stratum may be formed from two or more ink receiving layers different in composition from each other. In the case where two or more porous ink receiving layers are formed on a substrate sheet, particularly a substrate sheet having a low-water-absorption or a non-water-absorbing substrate sheet, and the upper ink receiving layer is formed on an under ink receiving layer after the under layer is completely dried, air bubbles remaining in the pores formed in the under ink receiving layer bloat up through the aqueous coating liquid layer for the upper ink receiving layer coated on the under layer, and form crater-like defects in the surface portion of the upper layer, or cause the smoothness of the upper layer surface to be significantly decreased.

In this case, the ink images recorded on the upper ink receiving layer exhibit a very degraded quality and the gloss of the upper layer surface is unsatisfactory.

The inventors of the present invention made an extensive study to solve the above-mentioned problems, and found that the problems can be solved by the following procedures. Namely, when two or more porous ink receiving layers comprising, as principal components, a pigment and a binder are formed on a substrate, at least an ink receiving outermost layer is formed on an ink receiving inside layer adjacent to the outermost layer in such a manner that a coating liquid for the outermost layer is coated on a coating liquid layer for the adjacent inside layer before the coating liquid layer for the adjacent inside layer is dried, and both the coating liquid layers for the inside and outermost layers are simultaneously dried, to form the outermost layer and the inside layer adjacent to the outermost layer. The resultant recording stratum is quite free from the problems.

In the process for producing the ink jet recording material of the present invention in such a manner that an aqueous coating liquid comprising fine pigment particles and a binder is coated on at least one surface of a substrate to form at least one ink receiving inside layer, and an aqueous coating liquid comprising fine pigment particles and a binder is coated on an outer surface of the ink receiving inside layer to form an ink receiving outermost layer, the aqueous coating liquid for the ink receiving outermost layer is coated on the aqueous coating liquid layer for the ink receiving inside layer adjacent to the outermost layer before the aqueous coating liquid layer for the adjacent inside layer is dried, and both the aqueous coating liquid layers for the outermost layer and the adjacent inside layer are simultaneously dried.

In an embodiment for carrying out the above-mentioned process, the ink receiving inside layer and the ink receiving outermost layer are formed by such a manner that the coating procedure for coating liquid for the ink receiving inside layer onto the substrate and the coating procedure for coating liquid for the ink receiving outermost layer onto the adjacent ink receiving inside layer are successively carried out through a plurality of coating liquid-feeding slits of a plurality of coating apparatuses located independently of each other. In this case, particularly, the coating apparatus for applying a stream of the coating liquid for the outermost layer to the wetted coating liquid layer for the adjacent inside layer, is preferably selected from those capable of applying the coating liquid for the outermost layer without bringing it into contact with a stream of the coating liquid for the wetted adjacent inside layer, for example, slot die coaters (for example, ULTRA DIE COATER, made by INOUE KINZOKU K.K. and LIP COATER made by HIRANO TECSEED K.K.), slide die coaters and curtain coaters.

In another embodiment of carrying out the above-mentioned process, the ink receiving inside layer and the ink receiving outermost layer are formed in such a manner that the coating procedure of the coating liquid for the ink receiving inside layer onto the substrate and the coating procedure of the coating liquid for the ink receiving outermost layer onto the adjacent ink receiving inside layer are substantially simultaneously carried out through a plurality of coating liquid-feeding slits of a multi-layer coating apparatus.

The simultaneous multi-layer coating apparatus is different from the successive coating system using a plurality of coating apparatuses arranged independently from each other, and consists of a single coating system for simultaneously applying two or more coating liquids to a desired surface. In the simultaneous multi-layer coating system, substantially no contamination of the coating liquids for the ink receiving layers with each other occurs and the ink receiving layers each having a uniform thickness can be easily formed. For the simultaneous multi-layer coating procedure, a multi-coating slot die coater, a multi-coating slide die coater or a multi-coating slide curtain coater is preferably employed.

Figure 2:
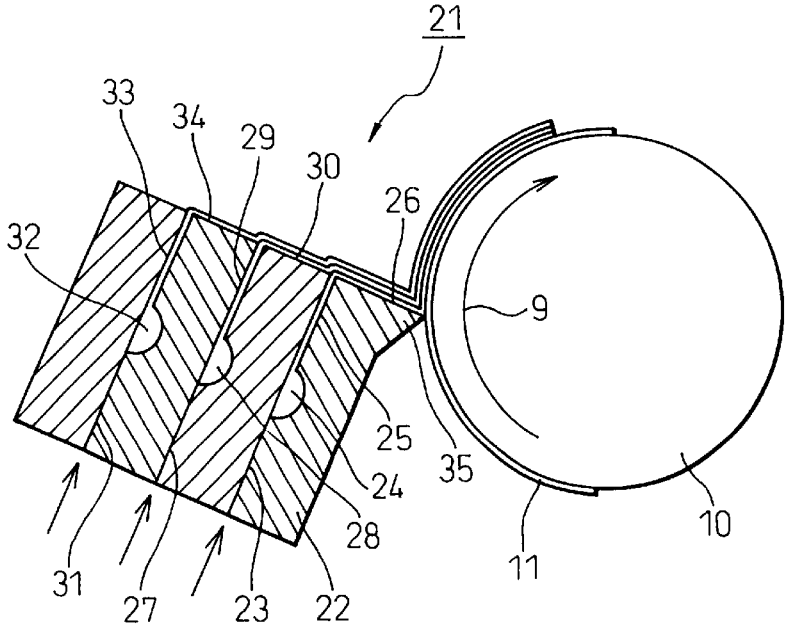
FIG. 2 shows an explanatory cross-sectional view of an embodiment of multi-coating slide die coaters for producing the ink jet recording material of the present invention.
Figure 3:
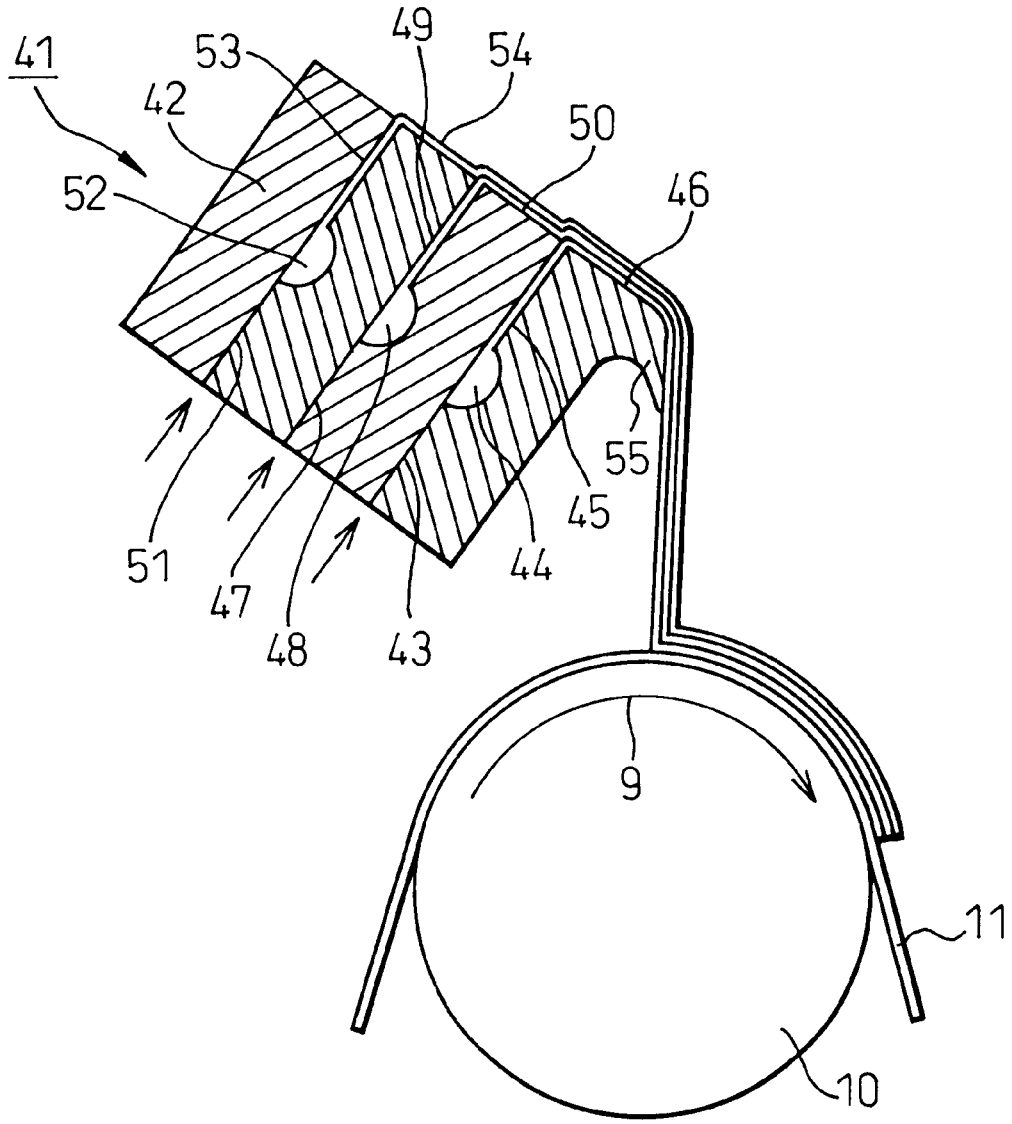
FIG. 3 shows an explanatory cross-sectional view of an embodiment of multi-coating curtain die coaters for producing the ink jet recording material of the present invention.

Examples of the simultaneous multi-coating slot die coater, the simultaneous multi-coating slide die coater and the simultaneous multi-coating slide curtain coater are respectively shown in FIG. 1, FIG. 2 and FIG. 3.

Referring to FIG. 1, a first coating liquid passage 3 formed in a die block 2 of a simultaneous multi-coating slot die coater 1 is connected to a supply source (not shown in FIG. 1) of a coating liquid for forming an ink receiving inside layer, and a second coating liquid passage 4 formed in the die block 2 is connected to a supply source (not shown in FIG. 1) of a coating liquid for forming an ink receiving outermost layer. A first coating liquid flowing through the first coating liquid passage 3 is passed through a first manifold 5 and is extruded as a first film-formed stream 6*a* through an outlet of a first slot 6. The first film-formed stream 6*a* of the first coating liquid is coated on a surface of a substrate 11 supplied onto a backing roll 10 which rotates in the rotation direction as shown by an arrow 9. On other hand, a second coating liquid fed into the second coating liquid passage 4 is passed through a second manifold 7 and is extruded as a second film-formed stream 8*a* of the second coating liquid through an outlet of a second slot 8. The extruded second film-formed stream 8*a* is laminated on the first film-formed stream 6*a* of the first coating liquid. The laminated first and second film-formed streams 6*a* and 8*a* are simultaneously dried by a drying means (not shown in FIG. 1), to form an ink receiving inside layer laminated on and fixed to the substrate and an ink receiving outermost layer laminated on and fixed to the inside layer.

Referring to FIG. 2, in a simultaneous slide die coater 21, a first coating liquid for forming an ink receiving inside under layer is fed into a first coating liquid passage 23 formed in a die block 22 and connected to a supply source (not shown in FIG. 2) for the first coating liquid, is passed through a first manifold 24 and is extruded as a first film-formed stream 26 of the first coating liquid through an outlet of the first slot 25. Also, a second coating liquid for forming an ink receiving inside upper layer is fed into a second coating liquid passage 27 connected to a supply source (not shown in FIG. 2) for the second coating liquid, is passed through a second manifold 28 and is extruded as a second film-formed stream 30 of the second coating liquid through an outlet of a second slot 29. The second film-formed stream 30 is laminated on the first film-formed stream 26. Further, a third coating liquid for forming an ink receiving outermost layer is fed from a supply source (not shown in FIG. 2) for the third coating liquid into a third coating layer passage 31, is passed through a third manifold 32, and is extruded as a third film-formed stream 34 of the third coating liquid, through an outlet of a third slot 33. The extruded third film-formed stream 34 is laminated on the second film-formed stream 30. The laminate stream consisting of the first, second and third film-formed streams is applied through a coating bill 35 of the die block onto a surface of a substrate 11 supplied on a backing roll 10 rotating in the direction shown by an arrow 9 and is simultaneously dried in a drying means (not shown in FIG. 2) to form a recording stratum having a lamination structure of an ink receiving inside under layer/an ink receiving inside upper layer/an ink receiving outermost layer, on the substrate.

Referring to FIG. 3, in the simultaneous multi-coating slide curtain coater 41, a first coating liquid for forming an ink receiving inside under layer is fed from a supply source (not shown in FIG. 3) of the first coating liquid into a first coating liquid passage 43 formed in a die block 42, is passed through a first manifold 44 and is extruded as a first film-formed stream 46 through an outlet of a first slot 45. Also, a second coating liquid for forming an ink receiving inside upper layer is fed from a supply source (not shown in FIG. 3) of the second coating liquid into a second coating liquid passage 47, is passed through a second manifold 48 and is extruded as a second film-formed stream 50 of the second coating liquid through an outlet of a second slot 49. The extruded second film-formed stream 50 is laminated on the first film-formed stream 46. Further, a third coating liquid for forming an ink receiving outermost layer is fed from a supply source (not shown in FIG. 3) of the third coating liquid into a third coating liquid passage 51, is passed through a third manifold 52 and is extruded as a third film-formed stream 54 of the third coating liquid through an outlet of a third slot 53. The extruded third film-formed stream 54 is laminated on the second film-formed stream 50. The resultant laminate stream consisting of the first, second and third film-formed streams falls down in the form of a curtain through a coating bill 55 of the die block, is coated on a surface of a substrate 11 on a backing roll 10 rotating in the direction shown by an arrow 9, and is simultaneously dried by a drying means (not shown in FIG. 3), to form a recording stratum having a laminate structure of an ink receiving inside lower layer/an ink receiving inside upper layer/an ink receiving outermost layer on the substrate.

In an embodiment, the multi-coating slide die coater is arranged in such a manner that a multi-coating die having a inclined surface is arranged close to a substrate located on the backing roll, for example, with a distance of 100 to 1000 μm. The coating liquids are fed through the slots and layers of the coating liquids are laminated on each other on the inclined surface of the die, while no mixing of the coating liquids due to connection currents of the coating liquids occurs, and are coated on the substrate to form a laminate structure consisting of a plurality of wetted coating liquid layers laminated on each other. When the laminated wetted coating liquid layers are dried, a recording stratum consisting of a plurality of ink receiving layers laminated on each other is formed. In this case, even after the drying, the ink receiving layers are not mixed with each other and a uniform composite stratum is formed. Also, the resultant recording stratum is substantially free from surface defects and has a smooth coating surface. When a fine pigment is employed, the resultant recording stratum exhibits an excellent gloss.

The ink usable for recording on the ink jet recording material of the present invention comprises, as indispensable components, a coloring material for forming colored images and a solvent for dissolving or dispersing the coloring material therein, and as optional components, a dispersing agent, a surfactant, a viscosity-modifier, specific resistance-regulating agent, a pH-adjuster, a mildew-proofing agent, and/or a coloring material solution or dispersion-stabilizing agent. The coloring material usable for the ink includes direct dyes, acid dyes, basic dyes, reactive dyes, edible coloring materials, disperse dyes, oil dyes, and various types of coloring pigments, and can be selected conventional recording coloring materials. The content of the coloring material in the ink is established in consideration of the type of the solvent component, and properties required of the ink. The ink usable for the ink jet recording material of the present invention may contain the coloring material in a content similar to that of the conventional inks, namely, 0.1 to 20% by weight.

The solvent of the ink usable for the ink jet recording material of the present invention may contain water and a water-soluble organic solvent which may be selected from, for example, alkyl alcohols having 1 to 4 carbon atoms, for example, methyl alcohol, ethyl alcohol, n-propyl alcohol, isopropyl alcohol, n-butyl alcohol and isobutyl alcohol; ketones, for example, acetone; ketone alcohols, for example, diacetone alcohol; polyalkylene glycols, for example, polyethylene glycol and polypropylene glycol; alkylene glycols having 2 to 6 alkylene groups, for example, ethylene glycol, propylene glycol, butylene glycol, triethylene glycol, thio diglycol, hexylene glycol and diethylene glycol; amides, for example, dimethyl formamide; ethers, for example, tetrahydrofuran; polyhydric alcohols, for example, glycerol; and lower alkyl ethers of polyhydric alcohols, for example, ethyelenglycolmethylether, diethyleneglycol methyl (or ethyl) ether, and triethylene glycol monomethylether.

In an embodiment of the ink jet recording material of the present invention, at least one ink receiving layer of the image-recording stratum further comprises, in addition to the binder and the fine pigment particle of at least one pigment selected from the group consisting of silica, aluminosilicate and α-, θ-, δ- and γ-aluminas and having an average particle size of 1 μm or less, an image-light resistance-enhancing agent comprising at least one member selected from the group consisting of phenolic compounds, boric acid, borate salts and cyclodextrin compounds.

In the ink jet recording material, preferably the image-recording stratum comprises a plurality of ink receiving layers superposed on each other, and an ink receiving layer located outermost of the image-recording stratum comprises the fine pigment particles and the binder. In this case, at least one ink receiving layer in the image-recording layer preferably contains an image light resistance-enhancing agent comprising at least one member selected from the group consisting of phenolic compounds, boric acid, borate salts and cyclodextrin compounds.

It has been made clear that the fading phenomenon of the ink jet recorded images by light is particularly significantly on an ink jet recording sheet which has an ink receiving layer containing fine pigment particles used for the purpose of enhancing the color density of the recorded images and/or of improving the gloss of the ink receiving layer surface. The reasons for the fading phenomenon are assumed that the resultant ink receiving layer has a high transparency and thus allows the light to easy transmit therethrough. Namely, to obtain a high ink jet recording performance and a high gloss, it is preferable that the ink receiving layer comprises fine pigment particles having a particle size of 1 μm or less, particularly fine pigment particles consisting of secondary particles having a secondary particle size of 1 μm or less and each comprising a plurality of primary particles agglomerated with each other to form the secondary particles, and more preferably each having a primary particle size of 4 to 30 nm. When the above-mentioned fine pigment particles are employed for the ink receiving layer, they cause the recorded ink images to exhibit a decreased light resistance.

The inventors of the present invention made an extensive study to solve the above-mentioned problems. As a result, the inventors found that the fading phenomenon on the ink images recorded in the ink receiving layer, particularly the ink receiving outermost layer, containing the fine pigment particles can be prevented or significantly reduced by containing an image light resistant-enhancing agent comprising at least one member selected from the group consisting of phenolic compounds, boric acid, borate salts and cyclodextrin compounds.

It is known that when the coloring material, for example, a dye, contained in the ink is fixed in the outer surface portion of the recording stratum, particularly, when the recording stratum is constituted from a plurality of ink receiving layers laminated on each other, of an ink receiving outermost layer, the images exhibit a high color density. Thus, in this case, the image light resistance-enhancing agent is preferably contained in the outermost surface portion of the recording stratum or in the ink receiving outermost layer.

To provide the image light resistance-enhancing agent comprising at least one member selected from phenolic compounds, boric acid, borate salts, and cyclodextrin compound contained in the ink receiving outermost layer, the image high resistance-enchaining agent is mixed into a coating liquid for forming the ink receiving outermost layer, and the resultant coating liquid is coated on the substrate or the ink receiving inside layer. However, the image light resistance-enhancing agent is contained in an effective amount in the ink receiving layer, the resultant ink receiving layer may exhibit a reduced mechanical strength and/or a reduced water resistance. Also, the image light and/or a borate salt, is mixed into the coating liquid, an agglomeration or a viscosity increase phenomenon may occur and it causes the coating operation to be difficult. Particularly, when a water-soluble polymer having hydroxyl groups, such as a polyvinyl alcohol compound, is employed as a binder component, since the bonding force between the pigment particles and the above-mentioned binder component is strong, the resultant coating layer can exhibit both a high ink-absorbing property and a high mechanical strength of the coating layer. However, when the above-mentioned binder is contained in the coating liquid, the binder is easily cross-linked with boric acid or the borate salt, the cross-linking reaction causes the viscosity of the coating liquid to be significantly increased, and the coating operation becomes difficult. To solve the above-mentioned problem, a coating layer comprising, as principal components, the pigment particles and the binder is formed, the surface of the coating layer is coated with a coating liquid containing an image light resistance-enhancing agent comprising at least one member selected from phenolic compounds, boric acid, borate salts and cyclodextrin compounds, to cause the image light resistance-enhancing agent to be contained in the resultant ink receiving layer. In this case, the coating liquid containing the image light resistance-enhancing agent may be coated on a coating liquid layer containing the pigment and the binder while the coating liquid layer is kept wetted, or on a dried coating layer containing the pigment and the binder.

The phenol compounds usable for the image light resistance-enhancing agent include dihydroxybenzenes, dihydroxybenzene sulfonic acid and water-soluble salts thereof, monohydroxybenzene sulfonic acid and water-soluble salts thereof, hydroxybenzoic acid and water-soluble salts thereof, sulfosalicylic acid and water-soluble salts thereof, arbutin, mononaphthols, and mononaphiholsulfonic acid and water-soluble salts thereof, and are preferably selected from hydroquinone, hydroquinonesulfonate salts, hydroquinonedisulfonate salts, pyrocatechol, pyrocatechol-3,5-disulfonate salts, hydroxybenzoate salts, sulfosalicylate salts, hydroxybenzenesulfonate salts, arbutin and naphthol compounds. Particularly, the hydroquinone derivatives, the pyrocatechol derivatives and/or phenolsulfonate salts can impart an excellent high resistance to the recorded ink images. More particularly, pyrocatechol-3,5-disulfonate salts, especially, a sodium salt thereof, trademark: TIRON), p-hydroxybenzenesulfonate salts, or hydroquinone-β-D-glucoside (arbumine) is used, the resultant recording material can record thereon ink images having an excellent light resistance. Also, a combination of a phenolic compound with a salt selected from salts of sodium, magnesium, calcium, aluminum, phosphorus, titanium, iron, nickel, copper, and zinc, for example, nitrates, sulfates, phosphates, hydrogen phosphates, citrates, propionates and chlorides of the above-mentioned elements, may be used as a light resistance-enhancing agent for the recorded images. More enhanced light resistance of the ink images recorded on the recording material can be obtained by using chlorides of divalent methods, especially, magnesium chloride or calcium chloride. The reasons for the significant enhancement of the light resistance is not completely clear. It is assumed that the dye contained in the ink for the ink jet recording and having a poor light resistance is stabilize or protected by the light resistance-enhancing agent in a certain mechanism.

The boric acid and borate salts usable for the image light resistance-enhancing agent include orthoboric acid, methaboric acid, tetraboric acid orthoborate salts, diborate salts, methaborate salts, tetraborate salts, pentaborate salts and octaborate salts. The salt-forming metals include alkali metals, for example, sodium and potassium, and alkaline earth metals, for example, calcium magnesium and barium.

The chlorodextrin compounds usable for the image light resistance-enhancing agent include α-cyclodextrin, β-cyclodextrin, γ-cyclodextrin, alkylated cyclodextrins, hydroxyalkylated cyclodextrins, and cation-modified cyclodextrins. Among these compounds, γ-cyclodextrin has a high water-solubility and can be contained in the ink receiving layer with a high efficiency, and thus is very suitable in practice.

The amount of the image light resistance-enhancing agent is preferably 0.1 to 10 g/m$^2$, more preferably 0.25 to 5 g/m$^2$, still more preferably 0.5 to 2.5 g/m$^2$, in the ink jet recording material. If the amount is less than 0.1 g/m$^2$, the resultant light resistance-enhancing effect for the ink images may be insufficient, and if the amount is more than 10 g/m$^2$, the resultant ink receiving layer may exhibit unsatisfactory ink absorption, mechanical strength and water resistance, and the recorded images may exhibit an insufficient clarity, color density, and water resistance, and the resultant ink receiving layer may have an unsatisfactory gloss.

The fine pigment particles contained in the ink receiving layer containing the image light resistance-enhancing agent are preferably in the form of secondary particles having an average secondary particle size 1 μm or less more preferably 10 to 500 nm, still more preferably 15 to 300 nm, further preferably 20 to 200 nm and each consisting of a plurality of primary particles having an average primary particle size of 3 to 40 nm more preferably 3 to 40 nm, still more preferably 5 to 30 nm, further preferably 7 to 20 nm, and agglomerated with each other.

The fine pigment particles are preferably fine particles of at least one member selected from fumed silica, amorphous silica, aluminas and alumina hydrates.

The fumed silica particles are preferably in the form of secondary particles having an average secondary particle size of 300 nm or less and each consisting of a plurality of primary particles having a primary particle size of 3 to 40 nm and agglomerated with each other.

The ink receiving layer comprising the fine pigment particles, the binder and the image light resistance-enhancing agent optionally further comprises a cationic compound.

The binder preferably comprises at least one member selected from the group consisting of water-soluble polymeric compounds, latices of copolymers of conjugated diene compounds, latices of vinyl copolymers, water-dispersible acrylic resins, water-dispersible polyester resins and water-dispersible polyurethane resins.

The binder preferably comprises at least one member selected from the group consisting of polyvinyl alcohol, partially saponificated polyvinyl alcohols, acetacetylated polyvinyl alcohols, silyl-modified polyvinyl alcohols, cation-modified polyvinyl alcohols, and anion-modified polyvinyl alcohols.

The substrate for the image light resistance-enhancing agent-containing ink jet recording material is preferably formed from an ink-nonabsorbing material.

Also, in the ink jet recording material, as claimed in the surface of the image-recording stratum preferably has a 75° specular gloss of 30% or more.

EXAMPLES

The present invention will be further illustrated by the following examples. In the examples and comparative examples, the terms "part" and "%" are respectively parts by dry solid weight and % by dry solid weight, unless otherwise defined. It should be noted that a primary particle size of pigment particles is not changed by pulverization and dispersion of secondary particles of the pigment.

The average size of fine pores formed in pigment particles was calculated from BET absorption values of the pigment particles measured by a BET tester (model: NOVA 1200, made by CANTACHROM (O.)

In Examples I-1 to I-30 and Comparative Examples I-1 to I-9, the following pigment particles were employed.

Silica sol A-1

Precipitation method silica particles (trademark: FINESIL X-45, made by TOKUYAMA K.K., average primary particle size: about 10 nm, average secondary particle size: about 4.5 μm) were repeatedly dispersed and pulverized in water by using a sand grinder and then by a nanomizer (trademark: NANOMIZER, made by NANOMIZER CO.), the resultant aqueous dispersion was subjected to a classification, to provide an aqueous dispersion containing 10% by dry solid weight of the silica particles having an average secondary particle size of 80 nm. The aqueous dispersion in an amount of 100 parts by dry solid weight was mixed with 15 parts by dry solid weight of a cationic resin consisting of diallyldimethyl quaternary ammonium-hydrochloric acid salt (trademark: UNISENCE CP-103, made by SENKA K.K.), to cause the pigment particles to agglomerate with each other through the cationic resin and the pigment dispersion to be thickened. Then, the pigment dispersion was subjected to repeated pulverization and dispersion procedures using the nanomizer, to prepare an aqueous silica dispersion (Silica sol A-1) containing 8% by dry solid weight of the agglomerated silica particles having an average secondary particle size of 250 nm.

Silica sol B-1

Fumed silica particles (trademark: REOROSIL QS-30, made by TOKUYAMA K.K., specific surface area: 300 $m^2/g$, average primary particle size: about 10 nm, combustion method silica were repeatedly dispersed and pulverized in water by using a sand grinder and then by a nanomizer, the resultant aqueous dispersion was subjected to a classification, to provide an aqueous dispersion containing 10% by dry solid weight of the silica particles having an average secondary particle size of 80 nm. The aqueous dispersion in an amount of 100 parts by dry solid weight was mixed with 15 parts by dry solid weight of a cationic resin consisting of diallyldimethyl quaternary ammonium-hydrochloric acid salt (trademark: UNISENCE CP-103, made by SENKA K.K.), to cause the pigment particles to agglomerate with each other through the cationic resin and the pigment dispersion to be thickened. Then, the pigment dispersion was subjected to repeated pulverization and dispersion procedures using the nanomizer, to prepare an aqueous silica dispersion (Silica sol B-1) containing 8% by dry solid weight of the agglomerated silica particles having an average secondary particle size of 250 nm.

Silica sol A-2

Gel method silica particles (trademark: SYLOJET P403, made by GRACE DAVISON K.K., average secondary particle size: about 3 μm) were repeatedly dispersed and pulverized in water by using a sand grinder and then by a MICROFLUIDIZER (model: M-110-EH, made by MICROFLUIDICS CO.), to provide an aqueous dispersion containing 10% by dry solid weight of the silica particles (Silica sol A-2) having an average secondary particle size of 450 nm.

Silica sol B-2

Wet method silica particles (trademark: NIPSIL HD-2, made by NIHON SILICA KOGYO K.K., average primary particle size: 11 nm, average secondary particle size: 3 μm) were repeatedly dispersed and pulverized in water by using a sand grinder to provide an aqueous dispersion containing 10% by dry solid weight of the silica particles having an average secondary particles of 450 nm. The aqueous dispersion in an amount of 100 parts by dry solid weight was mixed with 15 parts by dry solid weight of a cationic resin consisting of diallyldimethyl quaternary ammonium-hydrochloric acid salt (trademark: UNISENCE CP-103, molecular weight: 100,000, made by SENKA K.K.), to cause the pigment particles to agglomerate with each other through the cationic resin and the pigment dispersion to be thickened. Then, the pigment dispersion was subjected to repeated pulverization and dispersion procedures using the sand grinder, to prepare an aqueous silica dispersion (Silica sol B-2) containing 10% by dry solid weight of the agglomerated silica particles having an average secondary particle size of 450 nm.

Silica sol C

The silica sol B-2 was repeatedly pulverized and dispersed by using a sand grinder and then by a microfluidizer, to prepare an aqueous silica dispersion (Silica sol C) containing 10% by dry solid weight of silica particles having an average secondary particle size of 300 nm.

Silica sol D

Fumed silica particles (trademark: REOLOSIL QS-102, made by TOKUYAMA K.K., specific surface area: 200 $m^2/g$, average primary particle size: about 15 nm calculated from the specific surface area value, $SiO_2$ content: 99.9% or more) were repeatedly dispersed and pulverized in water by using a sand grinder and then by a microfluidizer, to provide an aqueous dispersion (Silica sol D) containing 10% by dry solid weight of the silica particles having an average secondary particle size of 80 nm.

Silica sol E

The silica sol D in an amount of 100 parts by dry solid weight was mixed with 15 parts by dry solid weight of a cationic resin consisting of diallyldimethyl quaternary ammonium-hydrochloric acid salt (trademark: UNISENCE CP-103, molecular weight: 100,000, made by SENKA K.K.), to cause the pigment particles to agglomerate with each other through the cationic resin and the pigment dispersion to be thickened. Then, the pigment dispersion was subjected to repeated pulverization and dispersion procedures using the sand grinder and then the microfluidizer, to prepare an aqueous silica dispersion (Silica sol E) containing 10% by dry solid weight of the agglomerated silica particles having an average secondary particle size of 100 nm.

Alumina sol (a)

Alumina particles (trademark: AKP-20, α-alumina, made by SUMITOMO KAGAKUKOGYO K.K.) were repeatedly dispersed and pulverized in water by using a sand grinder and then by a microfluidizer, to provide an aqueous dispersion (Alumina sol (a)) containing 10% by dry solid weight of the alumina particles having an average secondary particle size of 400 nm.

Alumina sol (b)

Alumina particles (trademark: AKP-G015, γ-alumina, BET specific surface area: 150 $m^2/g$, fine pore volume: 0.5 ml/g, fine pore size: 6.0 nm, made by SUMITOMO KAGAKUKOGYO K.K.) were repeatedly dispersed and pulverized in water by using a sand grinder and then by a microfluidizer, to provide an aqueous dispersion (Alumina sol (b)) containing 10% by dry solid weight of the alumina particles having an average particle size of 200 nm.

Alumina sol (c)

The same procedures as for alumina sol (b) were repeated, except that the alumina particles under the trademark of AKP-G105 were replaced by other alumina particles under the trademark of AKP-G020 (made by SUMITOMO KAGAKUKOGYO K.K., BET specific surface area: 200 $m^2/g$, fine pore volume: 0.5 ml/g, fine pore size: 4.5 nm, to prepare alumina sol (c)

Alumina sol (d)

Fumed alumina particles made by CABOT CO. were repeatedly dispersed and pulverized in water by using a sand grinder and then by a microfluidizer, to provide an aqueous dispersion containing 10% by dry solid weight of the fumed alumina particles containing θ-alumina, δ-alumina and γ-alumina in a mixing weight ratio of about 3:1:1) and having an average particle size of 300 nm.

Aluminosilicate sol

Isopropyl alcohol in an amount of 100 g was charged in a glass reactor vessel having a capacity of 2 liters and heated to a temperature of 60° C. by using an oil bath heater. Then, the isopropyl alcohol was added with 5 g of aluminum isopropoxide (made by WAKO JUNYAKUKOGYO K.K.) and then with 1.0 g of an acid catalyst consisting of acetic acid (made by WAKO JUNYAKUKOGYO K.K.), while stirring the mixture in the vessel with stirring wings (diameter: 3 cm, three wings) at a rotation rate of 1.67 rps (100 rpm) and the resultant mixture was refluxed for 24 hours, while maintaining the temperature of the mixture at 60° C.

Separately from the above-mentioned procedures, ion-exchanged water in an amount of 100 g was placed in a glass reactor vessel, heated to a temperature of 60° C. and mixed with 1.8 g of ethyl orthosilicate (made by WAKO JUNYAKUKOGYO K.K.) and then with 1.0 g of an acid catalyst consisting of nitric acid (made by WAKO JUNYAKUKOGYO K.K.) The resultant mixture was refluxed for 24 hours while the temperature of the mixture is maintained at 60° C.

The above-mentioned ethyl orthosilicate-nitric acid-ion-exchanged water solution was mixed into the above-mentioned aluminum isopropoxide-acetic acid-isopropyl alcohol solution, and the mixture was stirred at a temperature of 60° C. for 6 hours, to prepare a dispersion of fine particles of aluminosilicate. Then, the resultant aluminosilicate particle dispersion was heated at a temperature of 60° C. in an evaporator to concentrate the dispersion. Agglomerates of the aluminosilicate particles were obtained. The resultant aluminosilicate particles had a molar ratio of alumina to silica of 3:2. The agglomerates were added with water, dispersed in water by a sand grinder and further dispersed by a microfluidizer, the dispersion procedures by the sand grinder and then by the microfluidizer were repeated until the average secondary particle size of the particles reached 200 nm (average primary particle size: 10 nm). An aqueous dispersion containing 10% by dry solid weight of aluminosiliate particles having an average secondary particle size of 450 nm.

In Examples I-1 to I-30 and Comparative Examples I-1 to I-9, the following substrate sheets were employed.

Substrate Sheet A

A bleached softwood kraft pulp (NBKP) having a Canadian Standard Freeness (CSF) of 250 ml determined in accordance with JIS P 8121 and a bleached hardwood kraft pulp (LBKP) having a CSF of 280 ml were mixed with each other in a mixing weight ratio of 2.8 in an aqueous medium, to provide an aqueous pulp slurry having a pulp content of 0.5% by dry solid weight. The pulp slurry was mixed with 2.0% by weight of a cationic starch, 0.4% by weight of an alkylyketenedimer, 0.1% by weight of an anionic polyacrylamide resin and 0.7% by weight of a polyamidepolyamineepichlorohydrin resin, based on the bone dry weight of the mixed pulp, and the resultant mixture was fully stirred to prepare an uniform pulp slurry.

The pulp slurry having the above-mentioned composition was subjected to a paper-forming procedure using a wire paper machine, the resultant wetted paper sheet was passed through a dryer, a sizepress and a machine calender, to provide a paper sheet having a basis weight of 180 $g/m^2$ and a bulk density of 1.0 $g/cm^3$. The sizepress liquid used in the above-mentioned sizepress procedure was prepared by mixing a carboxyl-modified polyvinyl alcohol and sodium chloride with each other in a weight ratio of 2:1, dissolving the resultant mixture in water at a temperature of 90 to 95° C. to prepare a sizepress solution having a dry solid content of 5% by weight. The sizepress solution was coated on both the front and back surface of the paper sheet, in a total coating amount of 25 $ml/m^2$. A substrate sheet A was obtained.

Substrate Sheet B

A corona discharge treatment was applied onto both the front and back surfaces of the same base paper sheet as the substrate sheet (A) as mentioned above. Then, on the front (felt side) surface of the corona discharge treated paper sheet, a polyolefin resin composition 1 prepared in the composition shown below by a mixing and dispersing procedure by a Banbury mixer was coated in a dry coating amount of 25 $g/m^2$, and on the back (wire side) surface of the corona discharge-treated paper sheet, a polyolefin resin composition having the composition as shown below and prepared by a Banbury mixer was coated in a dry coating amount of 20 $g/m^2$. Each coating procedure was carried out by using a melt-extruder having a T type die at a melt temperature of 320° C. The front (felt side) polyethylene resin composition 1 layer was cooled and solidified by a cooling roll having a mirror-finished peripheral surface and the back (wire side) polyolefin resin composition 2 layer was cooled and solidified by a cooling roll having a roughened surface. The resultant resin coated substrate sheet B had a front surface smoothness of 6000 seconds determined in accordance with Japan TAPPI No. 5, OKEN type tester, and an opaqueness of 93% determined in accordance with Japanese Industrial Standard P 8138.

Polyolefin resin composition 1

| Component | Parts by dry solid weight |
|---|---|
| Linear low density polyethylene resin (density: 0.926 $g/cm^3$, melt index: 20 g/10 minutes) | 35 |
| Low density polyethylene resin (density: 0.919 $g/cm^3$, melt index: 2 g/10 minutes) | 50 |
| Anatase type titanium dioxide (trademark: A-220, made by Ishihara Sangyo K.K.) | 15 |
| Zinc stearate | 0.1 |
| Antioxidant (trademark: IRGANOX 1010, made by CIBA GEIGY) | 0.03 |
| Ultramarin (trademark: BLUISH ULTRAMARINE NO. 2000, made by DAIICHI KASEI K.K.) | 0.09 |

-continued

Polyolefin resin composition 1

| Component | Parts by dry solid weight |
|---|---|
| Fluorescent brightening agent (trademark: UVITEX OB, made by CIBA GEIGY) | 0.3 |
| High density polyethylene resin (density: 0.954 g/cm$^3$, melt index: 20 g/10 minutes) | 65 |
| Low density polyethylene resin (density: 0.924 g/cm$^3$, melt index: 4 g/10 minutes) | 35 |

Substrate Sheet C

A resin-coated substrate sheet was prepared by the same procedures as for the substrate sheet B with the following exceptions.

The basis weight of the base paper sheet was changed to 101 g/m$^2$. The dry coating amount of the polyolefin resin composition 1 on the front (felt side) surface of the base paper sheet was changed to 15 g/m$^2$, and the dry coating amount of the polyolefin resin composition 2 on the back (wire side) of the base paper sheet was changed to 25 g/m$^2$. Also, the both surface coated sheet was curled upward on the back (wire side) surface thereof. The resultant resin-coated substrate sheet C had a front surface smoothness of 5000 seconds, determined in accordance with Japan TAPPI No. 5, OKEN Type tester, and an opaqueness of 90% determined in accordance with JIS P 8138.

Substrate Sheet D

The same base paper sheet as the substrate sheet A was treated on both the front and back surfaces with a corona discharge treatment. By using a melt extruder having a T-type die and a melting temperature of 320° C., the back (wire side) surface of the base paper sheet was coated with the polyolefin resin composition 2 (resin composition for back surface) in a dry coating amount of 20 g/m$^2$, and the polyolefin resin composition 2 layer was cooled and solidified by a cooling roll having a roughened peripheral surface. The resultant resin-coated substrate sheet D had a front surface smoothness of 6000 seconds determined in accordance with Japan TAPPI No. 5, OKEN Type tester, and an opaqueness of 93% determined in accordance with JIS P 8138.

Example I-1

An ink jet recording material of the present invention was produced by the following procedures.

An aqueous coating liquid for an ink receiving inside layer having a dry solid content of 15% by weight was prepared by mixing 100 parts by dry solid weight of gel method silica particles (trademark: SYLOJET P612, made by GRACE DAVISON CO.) having an average secondary particle size of 7.5 $\mu$m, an average primary particle size of 10 nm, fine pore volume of 1.16 ml/g and an average fine pore size of 16.2 nm with 35 parts by dry solid weight of a silyl-modified polyvinyl alcohol (trademark: PVA R-1130, made by KURARAY K.K.) The aqueous coating liquid was coated in a dry solid amount of 15 g/m$^2$ on the front surface of the same base paper sheet as substrate sheet A by using a die coater. Then, before the coating liquid layer was dried, an aqueous coating liquid for an ink receiving outermost layer prepared by mixing 100 parts by dry solid weight of the silica sol A-1 with 30 parts by dry solid weight of a polyvinyl alcohol (trademark: PVA-135H, made by KURARAY K.K.) having a degree of polymerization of 3500 and a degree of saponification of 99% or more, and having a total dry solid content of 8% by weight was coated in a dry solid amount of 5 g/m$^2$ on the wetted coating liquid layer by using a die coater, and then both the coating liquid layers were dried, to form the ink receiving inside and outermost layers.

Example I-2

An ink jet recording material was produced by the same procedures as in Example I-1 with the following exception.

The silica sol A-1 was replaced by silica sol B-1.

Example I-3

An ink jet recording material was produced by the same procedures as in Example I-2 with the following exception.

The substrate sheet A was replaced by the substrate B.

Example I-4

An ink jet recording material was produced by the following procedures.

An aqueous coating liquid for an ink receiving inside layer was prepared in a dry solid content of 15% by weight from a mixture of 100 parts by dry solid weight of gel method silica particles (trademark: SMSG-3U, made by GRACE DAVISON CO.) having an average secondary particle size of 300 nm, an average fine pore size of 12.5 nm, an average fine pore volume of 0.63 ml/g with 25 parts by dry solid weight of a polyvinyl alcohol (trademark: PVA-140H, made by KURARAY K.K.), and coated in a dry amount of 20 g/m$^2$ on a front surface of the substrate sheet B by using a die coater.

Then, before drying the coating liquid layer, an aqueous coating liquid for an ink receiving outermost layer prepared from a mixture of 100 parts by dry solid weight of silica sol B-1 with 25 parts by dry solid weight of a polyvinyl alcohol (trademark: PVA-140H, made by KURARAY K.K.) and having a total dry solid content of 8% by weight was coated on the wetted coating liquid layer to form an ink receiving outermost layer in a dry amount of 5 g/m$^2$. Then the coating liquid layers for the ink receiving inside and outermost layers were dried.

Example I-5

An ink jet recording material was produced by the same procedures as in Example I-4 with the following exception.

In the formation of the ink receiving inside layer, the gel method silica particles were replaced by alumina-modified gel method silica particles (trademark: WSSG-1CA, made by GRACE DAVISON CO.) having an average secondary particle size of 1 $\mu$m.

Example I-6

An ink jet recording material was produced by the same procedures as in Example I-4 with the following exception.

In the formation of the ink receiving inside layer, the gel method silica particles were replaced by cation-modified gel method silica particles (trademark: SMSG-3CS, made by GRACE DAVISON CO.) having an average secondary particle size of 300 nm, an average primary particle size of 12 nm, a fine pore volume of 0.63 ml/g and an average fine pore size of 11.3 nm.

Example I-7

An ink jet recording material was produced by the same procedures as in Example I-4 with the following exception.

The substrate sheet B was replaced by substrate sheet C.

Example I-8

An ink jet recording material was produced by the same procedures as in Example I-4 with the following exception.

The substrate sheet B was replaced by a polypropylene synthetic paper sheet (trademark: GWG-140, made by OJI YUKA K.K.)

Example I-9

An ink jet recording material was produced by the following procedures.

An aqueous coating liquid for an ink receiving outermost layer was prepared in a dry solid content of 8% by weight from a mixture of 100 parts by dry solid weight of silica sol B-particles with 25 parts by dry solid weight of a polyvinyl alcohol (trademark: PVA-140H, made by KURARAY K.K.), and coated in a dry amount of 5 g/m$^2$ on a front surface of a transparent polyethylene terephthalate (PEF) film (trademark: LUMIRROR-T, made by TORAY K.K.) having a thickness of 38 $\mu$m by using a die coater.

Then, before drying the coating liquid layer, an aqueous coating liquid for an ink receiving inside upper layer prepared from a mixture of 100 parts by dry solid weight of gel method silica particles (trademark: SMSG-3U, made by GRACE DAVISON CO.) having an average secondary particle size of 300 nm with 25 parts by dry solid weight of a polyvinyl alcohol (trademark: PVA-140H, made by KURARAY K.K.) and having a total dry solid content of 15% by weight was coated in a dry solid amount of 12 g/m$^2$ on the wetted coating liquid layer on the PET film by using a die coater. Then the coating liquid layers for the ink receiving inside upper and outermost layers were dried.

Separately, the same aqueous coating liquid as that for the ink receiving inside upper layer was coated in a dry solid amount of 3 g/m$^2$ on a front surface of substrate sheet A, and superposed on the two layer-coated PET film in such a manner that, while the coating liquid layer on the substrate sheet A was kept wetted, the ink receiving inside upper layer surface on the PET film was superimposed on the surface of the wetted coating liquid layer on the substrate sheet A, and then dried to form an ink receiving inside under layer. Finally, the PET film was peeled off from the ink receiving outermost layer, to leave an ink jet recording sheet comprising a substrate sheet A and a recording stratum consisting of ink receiving inside under and upper layer and an ink receiving outermost layer superposed successively on each other.

Comparative Example I-1

An ink jet recording material was produced by the following procedures.

An aqueous coating liquid for an ink receiving inside layer was prepared in a dry solid content of 15% by weight from a mixture of 100 parts by dry solid weight of gel method silica particles (trademark: SYLOJED P612, made by GRACE DAVISON CO.) having an average secondary particle size of 7.5 $\mu$m, an average primary particle size of 10 nm, an average fine pore volume of 1.16 ml/g and an average fine pore size of 16.2 nm, with 35 parts by dry solid weight of a silyl-modified polyvinyl alcohol (trademark: PVA R-1130, made by KURARAY K.K.), and coated in a dry amount of 10 g/m$^2$ on a front surface of the substrate sheet B by using a die coater.

Then, while the coating liquid layer was kept wetted, an aqueous coating liquid for an ink receiving outermost layer prepared from a mixture of 100 parts by dry solid weight of precipitation method silica particles (trademark: FINESIL X-20, made by TOKUYAMA K.K.) having an average secondary particle size of 1.9 $\mu$m, an average primary particle size of 10 nm, a fine pore volume of 1.53 ml/g and a fine pore size of 22.8 nm with 35 parts by dry solid weight of a silyl-modified polyvinyl alcohol (trademark: PVA R-1130, made by KURARAY K.K.) and 15 parts by dry solid weight of a cationic resin consisting of a diallyldimethyl quaternary ammonium-hydrochloric acid salt (trademark: UNISENCE CP-103, made by SENKA K.K.) and having a total dry solid content of 15% by weight was coated on the wetted coating liquid layer by using a die coater to form an ink receiving outermost layer in a dry amount of 10 g/m$^2$. Then the coating liquid layers for the ink receiving inside and outermost layers were dried.

Comparative Example I-2

An ink jet recording material was produced by the same procedures as in Comparative Example I-1 with the following exception.

The substrate sheet A was replaced by a PPC paper sheet.

Comparative Example I-3

An ink jet recording material was produced by the same procedures as in Comparative Example I-2 with the following exception.

The gel method silica particles (SYLOJET P612) was replaced by precipitation method silica particles (trademark: FINESIL X-45, made by TOKUYAMA K.K.) having an average secondary particle size of 4.5 $\mu$m, an average primary particle size of 10 nm, a fine pore volume of 1.60 ml/g and an average fine pore size of 22.6 nm.

Tests

The ink jet recording materials of Examples I-1 to I-9 and Comparative Examples I-1 to I-3 were subjected to the following tests for resistance of the ink images to blotting under high humidity condition, stability in color tone of the ink images and resistance of the recording materials to cockling, and test results were evaluated as follows.

The printer for the tests was an ink jet printer (model: PM-770C, made by EPSON K.K.) The printed image was a N1A portrait of GRAPHIC TECHNOLOGY-PREPRESS DIGITAL DATA EXCHANGE-STANDARD COLOUR IMAGE DATA (SCID), published by NIHON KIKAKU KYOKAI.

Resistance of Ink Images to Blotting Under High Humidity Condition

An ink jet recording sheet having printed ink images was stored in a room at a temperature of 23° C. at a relative humidity of 65% in a filed condition for one month, and the degree of blotting of the ink images was observed and evaluated as follows.

| Class | Resistance to blotting |
|---|---|
| 4 | Substantially no blotting of ink images is found. Very good. |
| 3 | A certain degree of blotting is found. Practically usable. |
| 2 | Image blotting is found. practical use is difficult. |

Stability in Color Tone of Ink Images

The term "stability in color tone of ink images" used herein theoretically relates to ΔE defined in "New Edition COLOR CHEMISTRY HANDBOOK" (the second edition), published by TOKYO DAIGAKU SHUPPANKAI, page 257 (1998). In the present invention, the stability was evaluated in the following manner.

Ink images were printed on each of the ink jet recording materials of the above-mentioned examples and comparative examples, and the printed recording material was stored under conditions of 23° C. and 65% RH for one week. Then the same ink images as those mentioned above were printed on the non-printed portion of the one week-stored recording material. Then the one week-stored ink images were compared with the newly printed ink images. A time after which the newly printed images appeared the same color tone as that of the one week-stored images by the naked eye observation, namely, the color tone of the newly printed images were fully stabilized, was measured by 10 men and 10 women. An average was calculated from the 20 results.

Resistance to Cockling

Immediately after printing ink images on the ink jet recording material, the cockling condition of the recording material was observed by the naked eye and evaluated as follows.

| Class | Resistance to cockling |
|---|---|
| 3 | No cockling is found. |
| 2 | Slight cockling is found. |
| 1 | Significant cockling is found. |

Gloss of Recording Material

The gloss of the recording material surface was observed by the naked eye and evaluated as follows.

| Class | Gloss |
|---|---|
| 4 | Excellent gloss |
| 3 | Good gloss similar to that of silver salt photographic sheet. (Also, the color density of recorded images are similar to that of silver salt photographic sheet.) |
| 2 | Glossy. Practically usable. |
| 1 | Poor gloss. Mat-like. |

The test results are shown in Table 1.

TABLE 1

| Example No. | | Item: Resistance of images to blotting under high humidity | Stability of color tone of image | Resistance of recording material to cockling | Gloss |
|---|---|---|---|---|---|
| Example | I-1 | 4 | 30 min | 2 | 2 |
| | I-2 | 4 | 20 min | 2 | 2 |
| | I-3 | 3 | 20 min | 3 | 2 |
| | I-4 | 3 | 10 min | 3 | 3 |
| | I-5 | 3 | 10 min | 3 | 3 |
| | I-6 | 3 | 10 min | 3 | 3 |
| | I-7 | 3 | 10 min | 3 | 3 |
| | I-8 | 3 | 15 min | 3 | 3 |
| | I-9 | 4 | 10 min | 2 | 4 |
| Comparative Example | I-1 | 4 | 30 min | 2 | 1 |
| | I-2 | 4 | 30 min | 1 | 1 |
| | I-3 | 4 | 300 min | 1 | 1 |

Table 1 clearly shows that the ink jet recording materials of the present invention exhibited satisfactory gloss and resistance to cockling and the recorded images had a high resistance to blotting under a high humidity condition and could be stabilized in color tone within a short time.

Example I-10

A front surface of substrate B was coated with an aqueous coating liquid containing a mixture of 100 parts by dry solid weight of silica sol A-2 with 30 parts by dry solid weight of a polyvinyl alcohol (trademark: PVA-140H, made by KURARAY) having a degree of polymerization of 4,000 and a degree of saponification of 99% or more and having a total dry solid content of 8% by weight, by using a Mayer bar, and dried to form an ink receiving inside layer in a dry solid amount of 30 g/m$^2$. The inside layer was coated with an aqueous coating liquid containing a mixture of 50 parts by dry solid weight of silica sol B-2 with 50 parts by dry solid weight of alumina sol (a) and 25 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar and dried, to form an ink receiving outermost layer having a dry solid amount of 5 g/m$^2$. An ink jet recording material was obtained.

Example I-11

An ink jet recording material was produced by the same procedures as in Example I-10 with the following exception.

The silica sol B-2 for the ink receiving outermost layer was replaced by silica sol C.

Example I-12

An ink jet recording material was produced by the same procedures as in Example I-10 with the following exceptions.

The silica sol B2 was replaced by silica sol E and the alumina sol (a) for the ink receiving outermost layer was replaced by alumina sol (b).

Example I-13

An ink jet recording material was produced by the same procedures as in Example I-12 with the following exception.

The alumina sol (b) was replaced by alumina sol (d).

Example I-14

A front surface of substrate B was coated with an aqueous coating liquid containing a mixture of 100 parts by dry solid weight of silica sol A-2 with 30 parts by dry solid weight of a polyvinyl alcohol (trademark: PVA-140H, made by KURARAY) having a degree of polymerization of 4,000 and a degree of saponification of 99% or more and having a total dry solid content of 8% by weight, by using a Mayer bar, and dried to form an ink receiving inside under layer in a dry solid amount of 30 g/m$^2$. The inside under layer was coated with an aqueous coating liquid containing a mixture of 100 parts by dry solid weight of alumina sol (b) with 10 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar and dried to form an ink receiving inside upper layer having a dry solid amount of 2.5 g/m$^2$. The ink receiving inside upper layer was coated with an aqueous coating liquid containing a mixture of 100 parts by dry solid weight of silica sol E with 25 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar, and dried to form an ink receiving outermost layer having a dry solid amount of 2.5 g/m$^2$.

An ink jet recording material having a recording stratum formed on the substrate sheet coat comprising the ink receiving inside under, inside upper and outermost layers superposed successively on each other, was obtained.

Example I-15

An ink jet recording material was produced by the same procedures as in Example I-14 with the following exception.

The alumina sol (b) for the ink receiving inside upper layer was replaced by alumina sol (c).

Example I-16

A front surface of substrate B was coated with an aqueous coating liquid containing a mixture of 100 parts by dry solid weight of silica sol A-2 with 30 parts by dry solid weight of a polyvinyl alcohol (trademark: PVA-140H, made by KURARAY) having a degree of polymerization of 4,000 and a degree of saponification of 99% or more and having a total dry solid content of 8% by weight, by using a Mayer bar, and dried to form an ink receiving inside under layer in a dry solid amount of 30 g/m$^2$. The inside under layer was coated with an aqueous coating liquid containing a mixture of 100 parts by dry solid weight of silica sol E with 25 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar and dried, to form an ink receiving inside upper layer having a dry solid amount of 2.5 g/m$^2$. The ink receiving inside upper layer was coated with an aqueous coating liquid containing a mixture of 100 parts by dry solid weight of alumina sol (b) with 10 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar and dried to form an ink receiving outermost layer having a dry solid amount of 2.5 g/m$^2$.

An ink jet recording material having a recording stratum formed on the substrate sheet coat comprising the ink receiving inside under, inside upper and outermost layers superposed successively on each other, was obtained.

Example I-17

An ink jet recording material was produced by the same procedures as in Example I-12 with the following exception.

The substrate sheet B was replaced by substrate sheet C.

Example I-18

An ink jet recording material was produced by the same procedures as in Example I-12 with the following exception.

The substrate sheet B was replaced by a synthetic paper sheet (trademark: YUPO GAG-130, made by OJI YUKA-GOSEISHI K.K.) having a three-layered laminate structure containing a polypropylene and an inorganic pigment and provided with a core base layer and paper-like layers formed on the front and back surfaces of the core base layer, and having a thickness of 130 $\mu$m.

Example I-19

A front surface of substrate B was coated with an aqueous coating liquid containing a mixture of 100 parts by dry solid weight of silica sol A-2 with 30 parts by dry solid weight of a polyvinyl alcohol (trademark: PVA-140H, made by KURARAY) having a degree of polymerization of 4,000 and a degree of saponification of 99% or more and having a total dry solid content of 8% by weight, by using a Mayer bar, and dried to form an ink receiving inside under layer in a dry solid amount of 30 g/m$^2$. The inside under layer was coated with an aqueous coating liquid containing a mixture of 100 parts by dry solid weight of alumina sol (b) with 25 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar and dried, to form an ink receiving inside upper layer having a dry solid amount of 2.5 g/m$^2$. The ink receiving inside upper layer was coated with an aqueous coating liquid containing a mixture of 100 parts by dry solid weight of silica sol D with 25 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar, and dried to form an ink receiving outermost layer having a dry solid amount of 2.5 g/m$^2$.

An ink jet recording material having a recording stratum formed on the substrate sheet coat comprising the ink receiving inside under, inside upper and outermost layers superposed successively on each other, and a cationic surface layer formed on the ink receiving outermost layer was obtained. The ink receiving outermost layer was coated with an aqueous solution containing a cationic quaternary ammonium salt monomer (trademark: AGEFLEX FM1 Q75MC, made by JPN CHEMICAL K.K., molecular weight: 200) and having a dry solid content of 3% by weight, in a dry solid amount of 1 g/m$^2$ and dried.

Example I-20

An ink jet recording material was produced by the same procedures as in Example I-19 with the following exception.

The cationic quaternary ammonium salt monomer coated on the ink receiving outermost layer was replaced by a cationic surface-treating agent (trademark: SYLOJET A200, made by GRACE DAVISON CO.)

Example I-21

A front surface of a coating base consisting of a polyethylene terephthalate (PET) film (trademark: LUMIRROR-T, made by TORAY K.K.) having a thickness of 38 μm and a surface roughness Ra of 0.02 μm) was coated with an aqueous coating liquid containing a mixture of 100 parts by dry solid weight of alumina sol (b) and 10 parts by dry solid weight of a polyvinyl alcohol (trademark: PVA-140H, made by KURARAY K.K.) having a polymerization degree of 4,000 and a saponification degree of 99% or more and having a total dry solid content of 8% by weight, by using a Mayer bar, and dried, to form an ink receiving outermost layer having a dry solid amount of 5 g/m$^2$.

The ink receiving outermost layer was coated with an aqueous coating liquid containing a mixture of 100 parts by dry solid weight of silica sol A-2 and 30 parts by dry solid weight of a polyvinyl alcohol (trademark: PVA-140H, made by KURARAY) having a polymerization degree of 4,000 and a saponification degree of 99% or more, and having a total dry solid content of 8% by weight, by using a Mayer bar, and dried to form an ink receiving inside layer having a dry solid amount of 30 g/m$^2$.

Separately, a front (felt side) surface of substrate sheet D was subjected to a corona discharge treatment and then to an extrusion lamination procedure with the same polyolefin resin composition as the polyolefin resin composition 1 prepared by a mixing and dispersing procedure using a Banbury mixer using a melt extruder provided with a T-type die at a melt temperature of 320° C., to form a polyolefin resin coating layer in an amount of 25 g/m$^2$.

While the polyolefin resin coating layer is kept in the melt state, the ink receiving inside layer on the casting base film was brought into contact with the melted polyolefin resin coating layer on the substrate sheet D to bond the ink receiving inside layer to the polyolefin resin coating layer, and then the polyolefin resin coating layer was cooled and solidified by a cooling roll with a mirror-finished peripheral surface. Then, the PET film was peeled off from the ink receiving outermost layer. An ink jet recording material having a recording stratum formed on the substrate D and having ink receiving inside and outermost layers was obtained.

Example I-22

A front surface of substrate B was coated with an aqueous coating liquid containing a mixture of 100 parts by dry solid weight of aluminosilicate with 30 parts by dry solid weight of a polyvinyl alcohol (trademark: PVA-140H, made by KURARAY) having a degree of polymerization of 4,000 and a degree of saponification of 99% or more and having a total dry solid content of 8% by weight, by using a Mayer bar, and dried to form an ink receiving inside layer having a dry solid amount of 30 g/m$^2$. The inside layer was coated with an aqueous coating liquid containing a mixture of 100 parts by dry solid weight of alumina sol (b) with 10 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar and dried, to form an ink receiving outermost layer having a dry solid amount of 5 g/m$^2$. An ink jet recording material having a recording stratum consisting of ink receiving inside and outermost layers was obtained.

Comparative Example I-4

An ink jet recording material was produced by the following procedures.

A front surface of substrate sheet B was coated with an aqueous coating liquid containing a mixture of 50 parts by dry solid weight of wet method silica particles (trademark: NIPSIL HD-2, made by NIHON SILICA KOGYO K.K.) having an average primary particle size of 11 nm and an average secondary particle size of 3 μm with 50 parts by dry solid weight of alumnina particles (trademark: A-26, made by SUMITOMO KAGAKUKOGYO K.K., α-crystal form, crystal size: 3 μm) and 10 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar, and dried to form a single ink receiving layer (recording stratum) having a dry solid amount of 20 g/m$^2$.

Comparative Example I-5

An ink jet recording material was produced by the following procedures.

A front surface of substrate sheet B was coated with an aqueous coating liquid containing a mixture of 100 parts by dry solid weight of silica sol B-1 with 30 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar, and dried to form a single ink receiving layer (recording stratum) having a dry solid amount of 20 g/m$^2$.

Comparative Example I-6

An ink jet recording material was produced by the following procedures.

A front surface of substrate sheet B was coated with an aqueous coating liquid containing a mixture of 100 parts by dry solid weight of alumina sol (a) and 10 parts by dry solid weight of a polyvinyl alcohol (trademark: PVA-140H, made by KURARAY K.K.) having a polymerization degree of 4,000 and a saponification degree of 99% or more, and having a total dry solid content of 8% by weight, by using a Mayer bar, and dried to form a single ink receiving layer (recording stratum) having a dry solid amount of 20 g/m$^2$.

Comparative Example I-7

An ink jet recording material was produced by the following procedures.

A front surface of substrate sheet B was coated with an aqueous coating liquid containing a mixture of 50 parts by dry solid weight of a pseudoboehmite sol (trademark: AS-3, made by SHOKUBAI KASEI K.K.) with 50 parts by dry solid weight of silica sol B-2 and 30 parts by dry solid weight of a polyvinyl alcohol (trademark: PVA-135, made by KURARAY K.K.) having a polymerization degree of 3,500 and a saponification degree of 99% or more, and having a total dry solid content of 8% by weight, by using a Mayer bar, and dried to form a single ink receiving layer (recording stratum) having a dry solid amount of 20 g/m$^2$.

Tests

Each of the ink jet recording materials of Examples I-10 to I-22 and Comparative Examples I-4 to I-7 were subjected to the following tests for smoothness, gloss, clarity of ink images, ink absorbing property and water resistance of ink images, and the test results were evaluated in the following classes.

The ink jet recording was carried out by using an ink jet printer (model: PM-770C, made by EPSON K.K.)

Smoothness and Gloss

The smoothness and gloss of the ink jet recording material surface was observed by the naked eye at an observation angle of 20 degrees to the recording surface and evaluated as follows.

| Class | Smoothness and gloss |
|---|---|
| 4 | Excellent smoothness and gloss comparative to those of color photograph. |
| 3 | High smoothness and gloss but slightly lower than those of color photograph. |
| 2 | Law smoothness and gloss. |
| 1 | Very bad smoothness and gloss. |

Clarity of Images

Each ink jet recording material was printed with images of ISO/JIS SCIDN1, and printed recording material was stored for one day. The clarity of the stored images were evaluated by the naked eyes of 10 adult men and 10 adult women. The results were evaluated by a point from 1 to 5, and an average of the evaluation results were calculated.

| | |
|---|---|
| Point 5 | Excellent |
| . | |
| . | |
| . | |
| 1 | Not clear |

Ink Absorbing Property

A square sample of the recording material having dimensions of 10 cm×10 cm was attached to a center portion of a woodfree paper sheet in A4 size, and was solid printed by a black-coloring ink in an ink-jetting amount of 15 g/m$^2$, and the blotting of the ink from the sample was observed and evaluated in such a manner that a woodfree paper sheet was superposed on the ink-printed sample of the recording material, and a time necessary to reaching a condition such that no ink was transferred from the ink-printed sample to the superposed woodfree paper sheet, was measured.

| Class | Time |
|---|---|
| 4 | Less than one second. |
| 3 | One second or more but less than 5 seconds. |
| 2 | Five seconds or more but less than one minute. |
| 1 | One minute or more. |

Water Resistance of Images

The ink images on the ink jet recording material was left to stand under room conditions for 24 hours. Thereafter, a water drop was dropped on the images, and one minute after, the water drop was wiped off. The water drop-wetted portion of the images were observed by the naked eye and evaluated as follows.

| Class | Water resistance |
|---|---|
| 4 | No blotting of ink images are found. |
| 3 | Blotting of ink images is slight. Practically usable. |
| 2 | Ink images are certainly blotted. |
| 1 | Blotting of ink images is significant. Practical use is difficult. |

The test results are shown in Table 2.

TABLE 2

| Example No. | | Smoothness and gloss | Clarity of images | Ink absorption | Water-resistance of images |
|---|---|---|---|---|---|
| | | Item | | | |
| Example | I-10 | 2 | 3.0 | 4 | 3 |
| | I-11 | 3 | 3.2 | 4 | 3 |
| | I-12 | 4 | 4.0 | 4 | 3 |
| | I-13 | 4 | 3.9 | 4 | 3 |
| | I-14 | 4 | 4.5 | 4 | 3 |
| | I-15 | 4 | 4.9 | 4 | 3 |
| | I-16 | 4 | 4.5 | 4 | 3 |
| | I-17 | 4 | 4.0 | 4 | 3 |
| | I-18 | 4 | 4.2 | 4 | 3 |
| | I-19 | 4 | 4.3 | 4 | 4 |
| | I-20 | 4 | 4.3 | 4 | 4 |
| | I-21 | 4 | 5.0 | 4 | 3 |
| | I-22 | 4 | 3.5 | 4 | 4 |
| Comparative Example | I-4 | 1 | 2.2 | 4 | 1 |
| | I-5 | 1 | 2.8 | 3 | 3 |
| | I-6 | 3 | 1.2 | 1 | 1 |
| | I-7 | 2 | 1.4 | 2 | 1 |

Table 2 clearly shows that the ink jet recording materials of the present invention had excellent smoothness, gloss and ink-absorbing property and the recorded ink images exhibited excellent clarity and water resistance. These properties are comparative to those of the silver salt photographic sheet, and thus the ink jet recording materials of the present invention is excellent for practice.

Example I-23

A front surface of substrate sheet A was simultaneously coated with a coating liquid A having the composition as shown below for forming an ink receiving inside layer on the substrate sheet A and a coating liquid B having the composition as shown below for forming an ink receiving outermost layer on the ink receiving inside layer, by using a two-coating slide die coater, and coated coating liquid layer were simultaneously dried.

An ink jet recording material of the present invention having a recording stratum consisting of the ink receiving inside layer in a dry solid amount of 15 g/m$^2$ and the ink receiving outermost layer in a dry solid amount of 5 g/m$^2$ was obtained.

Coating Liquid A

The coating liquid A was an aqueous coating liquid containing a mixture of 100 parts by dry solid weight of gel method silica particles (trademark: SYLOJET P403, made by GRACE DAVISON CO.) having an average secondary particle size of 3 $\mu$m with 35 parts by dry solid weight of a silyl-modified polyvinyl alcohol (trademark: PVA R-1130, made by KURARAY K.K.) and 5 parts by dry solid weight of a cationic resin (trademark: UNISENCE CP-103, made by SENKA K.K.) and having a total dry solid content of 15% by weight.

Coating Liquid B

The coating liquid B was an aqueous coating liquid containing a mixture of 100 parts by dry solid weight of silica sol A-2 and 30 parts by dry solid weight of a partially saponified polyvinyl alcohol (trademark: PVA 235, made by KURARAY) and having a total dry solid content of 8% by weight.

Example I-24

An ink jet recording material was produced by the same procedures as in Example I-23 with the following exception.

The substrate sheet A was replaced by substrate sheet B.

Example I-25

An ink jet recording material was produced by the same procedures as in Example I-23 with the following exception.

The ink receiving inside layer was formed from a coating liquid C as shown below.

Coating Liquid C

The coating liquid C was an aqueous coating liquid containing a mixture of 100 parts by dry solid weight of gel method silica particles (trademark: SYLOJET 703C, made by GRACE DAVISON CO.) having an average secondary particle size of 300 nm with 25 parts by dry solid weight of a polyvinyl alcohol (trademark: PVA-140H, made by KURARAY K.K.) and having a total dry solid content of 15% by weight.

Example I-26

An ink jet recording material was produced by the following procedures.

A front surface of substrate A was coated with the coating liquid C for forming an ink receiving inside layer on the substrate sheet A and the coating liquid B for forming an ink receiving outermost layer on the ink receiving inside layer, by using a two-coating slot die coater, and coated coating liquid layer were simultaneously dried.

An ink jet recording material of the present invention having a recording stratum consisting of the ink receiving inside layer in a dry solid amount of 15 g/m$^2$ and the ink receiving outermost layer in a dry solid amount of 5 g/m$^2$ was obtained.

Example I-27

An ink jet recording material was produced by the same procedures as in Example I-24 with the following exception.

The ink receiving inside layer was formed from the coating liquid C and the ink receiving outermost layer was formed from a coating liquid D having the following composition.

Coating Liquid D

The coating liquid D was an aqueous coating liquid containing a mixture of 100 parts by dry solid weight of silica sol A-1 and 30 parts by dry solid weight of a partially saponified polyvinyl alcohol (trademark: PVA 235, made by KURARAY K.K.) and having a total dry solid content of 8% by weight.

Example I-28

An ink jet recording material was produced by the following procedures.

A front surface of substrate sheet B was coated with the coating liquid C for forming an ink receiving inside layer in a dry solid amount of 15 g/m$^2$ by using a slot die coater and while the coating liquid C layer was kept in wetted condition before drying, further with the coating liquid B for an ink receiving inside outermost layer in a dry solid amount of 5 g/m$^2$, by using another slot die coater, and both the coating liquid layers for the ink receiving inside and outermost layers were simultaneously dried.

Example I-29

An ink jet recording material was produced by the following procedures.

A front surface of substrate sheet B was coated with the coating liquid C for forming an ink receiving inside layer in a dry solid amount of 15 g/m$^2$ by using a curtain coater and while the coating liquid C layer was kept in wetted condition before drying, further with the coating liquid B for an ink receiving inside outermost layer in a dry solid content of 5 g/m$^2$, by using another curtain coater, and both the coating liquid layers for the ink receiving inside and outermost layers were simultaneously dried.

Example I-30

An ink jet recording material was produced by the same procedures as in Example I-25 with the following exception.

The substrate sheet A was replaced by a polypropylene synthetic paper sheet (trademark: GWG-140, made by OJI YUKAGOSEISHI K.K.)

Comparative Example I-8

The substrate sheet A was employed as an ink jet recording material.

Comparative Example I-9

The substrate sheet B was employed as an ink jet recording material.

Tests

Each of the ink jet recording materials of Examples I-23 to I-30 and Comparative Examples I-8 to I-9 was subjected to the following tests and evaluations of ink absorbing property, color density of recorded images, gloss of recorded images, smoothness and water resistance.

The printing for the recording material was carried out by using an ink jet printer (model: PM-770C, made by EPSON K.K.)

The ink absorption of the ink jet recording material was measured and evaluated in the same manner as mentioned above.

Color Density of Recorded Images

A solid black-colored images recorded on the recording material was subjected to a measurement of color density of the solid images using a Macbeth color density tester (model: RD-920, made by Macbeth). The measurement was repeated three times and an average value of the resultant data was calculated.

White Sheet Gloss

A 75° specular gloss of non-printed portion of the recording material was measured in accordance with JIS P 8142.

Gloss of Recorded Images

A 75° specular gloss of solid black-colored images was measured in accordance with JIS P 8142.

Smoothness

The smoothness of the front surface of the recording material was observed by the naked eye and evaluated in the following five classes.

| Class | Smoothness |
|---|---|
| 5 | Extremely excellent. |
| 4 | Excellent. |
| 3 | Good. |
| 2 | Slightly bad. |

Collective Evaluation

The appearance (including gloss and smoothness) and clarity of the recorded images were collectively evaluated in the following five classes.

| Class | Collective evaluation |
|---|---|
| 5 | Extremely excellent. |
| 4 | Excellent. |
| 3 | Good. |
| 2 | Slightly bad. |
| 1 | Bad. |

The test results are shown in Table 3.

TABLE 3

| Example No. | | Item | | | | | |
|---|---|---|---|---|---|---|---|
| | | Ink absorption | Color density of images | White sheet gloss (%) | Gloss of images (%) | Smoothness | Collective evaluation |
| Example | I-23 | 4 | 2.10 | 15 | 25 | 3 | 3 |
| | I-24 | 4 | 2.25 | 20 | 35 | 4 | 3 |
| | I-25 | 4 | 2.35 | 50 | 70 | 5 | 5 |
| | I-26 | 4 | 2.35 | 50 | 70 | 5 | 5 |
| | I-27 | 4 | 2.25 | 35 | 50 | 4 | 4 |
| | I-28 | 4 | 2.30 | 40 | 60 | 4 | 4 |
| | I-29 | 4 | 2.30 | 40 | 60 | 4 | 4 |
| | I-30 | 4 | 2.35 | 55 | 75 | 5 | 5 |
| Comparative | I-8 | 1 | 1.30 | 8 | 10 | 1 | 1 |
| Example | I-9 | 1 | — | 90 | — | 5 | 1 |

In comparison of Example I-23 with Example I-24, it is clear that when the liquid-non-absorbing substrate sheet B having a higher smoothness than that of the substrate sheet A consisting of a paper sheet is used the resultant color density of the images, the gloss and smoothness are higher that when the substrate sheet A is used.

In comparison of Example I-25 with Example I-24 or I-26, it is clear that the pigment particles contained in the ink receiving inside layer of Example 25 and having a smaller particle size than that of Example 26 or Example 24, cause the resultant color density of the recorded images, gloss and smoothness to be higher than those in Example 24 or 26.

In comparison of Example I-27 with Example I-25 or I-26, it is clear that the fumed silica particles contained in the ink receiving outermost layer contributed to enhancing the color density of recorded images, gloss and smoothness. Also, in Example I-25 or I-26, the ink receiving outermost layer formed by coating liquid in a dry solid amount of 5 g/m$^2$ on a transparent PET film surface exhibited a haze value of 7%, and in Example 27, the ink receiving outermost layer formed by coating a coating liquid in a dry solid amount of 5 g/m$^2$ on a transparent PET film exhibited a haze value of 15%.

In Examples I-25 and I-26, a plurality of the ink receiving layers were formed by a simultaneous multi-coating procedure, and the resultant recording materials had slightly higher gloss and smoothness than those in Examples I-28 or I-29.

In Example I-30, the substrate consisted of a smooth synthetic paper sheet (trademark: YUPO), and the resultant recording material exhibited the same good properties as those of the recording materials including the substrate sheet B.

The ink jet recording material of the present invention can record thereon ink images having a high color density and exhibits a high ink absorbing property, smoothness and gloss, and thus is useful for practice.

In Examples II-1 to II-34 and Comparative Examples II-1 to II-12, the following substrate sheets and fine pigment particles were employed.

Preparation of Substrate Sheets Substrate Sheet A-II

An aqueous pulp slurry having a dry solid content of 0.5% by weight was prepared from 100 parts by dry solid weight of a wood pulp (LBKF, CSF: 500 ml), 10 parts by dry solid weight of calcined kaolin (trademark: Ansilex), 0.05 part by dry solid weight of a trade-available sizing agent, 1.5 parts by dry solid weight of aluminum sulfate, 0.5 part by dry solid weight of a wet strength-enhancing agent, and 0.75 part by dry solid weight of starch. The pulp slurry was subjected to a wire paper forming machine, a dryer, and a machine calender, to produce a substrate paper sheet (substrate sheet A-II) having a basis weight of 120 g/m$^2$ and a bulk density of 0.80 g/cm$^3$. The substrate sheet A-II had a stöght size degree of 10 seconds.

Substrate Sheet B-II

This is the same as substrate sheet A mentioned above.

Substrate Sheet C-II

This was prepared by the same procedures as for substrate B with the following exceptions.

The resultant front polyolefine resin-coating layer surface was subjected to a corona discharge treatment and then coated with an anchor layer having the following composi tion and in a dry solid amount of 0.3 g/m$^2$, by using a gravure coater.

| Anchor layer | |
|---|---|
| Component | Parts by dry solid weight |
| Gelatin (trademark: GO 282K, made by NITTA GELATIN K.K.) | 100 |
| Surfactant (trademark: EMAL E27C, made by KAO K.K.) | 0.005 |

The resultant substrate C-II had a front surface smoothness of 6000 seconds measured by JAPAN TAPPI No. 5, OKEN type tester, and an opaqueness of 93% determined in accordance with JIS P 8138.

Precipitation of Fine Pigment Particles Fine Pigment Particles A-II

Precipitation method silica particles (trademark: FINESIL X-45, made by TOKUYAMA K.K., average primary particle size: about 10 nm, average secondary particle size: about 4.5 μm) were repeatedly dispersed and pulverized in water by using a sand grinder and then by a nanomizer (trademark: NANOMIZER, made by NANOMIZER CO.), to provide an aqueous dispersion containing 12% by dry solid weight of the silica particles having an average secondary particle size of 80 nm.

Fine pigment particles A1-II

Precipitation method silica particles (trademark: FINESIL X-45, made by TOKUYAMA K.K., average primary particle size: about 10 nm, average secondary particle size: about 4.5 μm) were repeatedly dispersed and pulverized in water by using a sand grinder and then by a nanomizer (trademark: NANOMIZER, made by NANOMIZER CO.), to provide an aqueous dispersion containing 12% by dry solid weight of the silica particles having an average secondary particle size of 50 nm. The aqueous dispersion in an amount of 100 parts by dry solid weight was mixed with 10 parts by dry solid weight of a cationic resin (trademark: SUMIREZ RESIN #1001, made by SUMITOMO KAGAKUKOGYO K.K.), to cause the pigment particles to agglomerate with each other through the cationic resin and the pigment dispersion to be thickened. Then, the pigment dispersion was subjected to repeated pulverization and dispersion procedures using the nanomizer, to prepare an aqueous silica dispersion (Fine pigment particles A1-II) containing 10% by dry solid weight of the agglomerated silica particles having an average secondary particle size of 100 nm.

Fine Pigment Particles A2-II

Precipitation method silica particles (trademark: FINESIL X-45, made by TOKUYAMA K.K., average particle size: about 10 nm, average secondary particle size: about 4.5 μm) were dispersed and pulverized in water by using a sand grinder to provide an aqueous dispersion containing 12% by dry solid weight of the silica particles having an average secondary particle size of 1 μm. The aqueous dispersion in an amount of 100 parts by dry solid weight was mixed with 10 parts by dry solid weight of a cationic resin (trademark: SUMIREZ RESIN #1001, made by SUMITOMO KAGAKUKOGYO K.K.), to cause the pigment particles to agglomerate with each other through the cationic resin and the pigment dispersion to be thickened. Then, the pigment dispersion was subjected to repeated pulverization and dispersion procedures using a sand grinder, to prepare an aqueous silica dispersion (fine pigment particles A2-II) containing 10% by dry solid weight of the agglomerated silica particles having an average secondary particle size of 1.0 μm.

Fine Pigment Particles A3-II

Precipitation method silica particles (trademark: FINESIL X-45, made by TOKUYAMA K.K., average primary particle size: about 10 nm, average secondary particle size: about 4.5 μm) were repeatedly dispersed and pulverized in water by using a sand grinder and then by a nanomizer (trademark: NANOMIZER, made by NANOMIZER CO.), to provide an aqueous dispersion containing 10% by dry solid weight of the silica particles having an average secondary particle size of 80 nm. The aqueous dispersion in an amount of 100 parts by dry solid weight was mixed with 10 parts by dry solid weight of a cationic resin consisting of diallyldimethyl quaternary ammonium-hydrochloric acid salt (trademark: UNISENCE CP-103, made by SENKA K.K.), to cause the pigment particles to agglomerate with each other through the cationic resin and the pigment dispersion to be thickened. Then, the pigment dispersion was subjected to repeated pulverization and dispersion procedures using the nanomizer, to prepare an aqueous silica dispersion (fine pigment particles A3-II) containing 8% by dry solid weight of the agglomerated silica particles having an average secondary particle size of 250 nm.

Fine Pigment Particles B-II

Gel method silica particles (trademark: SYLOJET P612, made by GRACE DAVISON K.K., average primary particle size: about 10 nm, average secondary particle size: about 7.5 μm) were repeatedly dispersed and pulverized in water by using a sand grinder and then by a nanomizer (trademark: NANOMIZER, made by NANOMIZER CO.), to provide an aqueous dispersion (fine pigment particles B-II) containing 15% by dry solid weight of the silica particles having an average secondary particle size of 300 nm.

Fine Pigment Particles C1-II

Fumed silica particles (trademark: REOLOSIL QS-30, made by TOKUYAMA K.K., specific surface area: 300 m$^2$/g average primary particle size: about 10 nm, were repeatedly dispersed and pulverized in water by using a sand grinder and then by a nanomizer, to provide an aqueous dispersion containing 12% by dry solid weight of the silica particles having an average secondary particle size of 80 nm. The aqueous dispersion in an amount of 100 parts by dry solid weight was mixed with 10 parts by dry solid weight of a cationic resin (trademark: SUMIREZ RESIN #1001, made by SUMITOMO KAGAKUKOGYO K.K.), to cause the pigment particles to agglomerate with each other through the cationic resin and the pigment dispersion to be thickened. Then, the pigment dispersion was subjected to repeated pulverization and dispersion procedures using the nanomizer, to prepare an aqueous silica dispersion (fine pigment particles C1-II) containing 10% by dry solid weight of the agglomerated silica particles having an average secondary particle size of 100 nm.

Fine Pigment Particles C2-II

Fumed silica particles (trademark: REOLOSIL QS-30, made by TOKUYAMA K.K., specific surface area: 300 m$^2$/g average primary particle size: about 10 nm, were repeatedly dispersed and pulverized in water by using a sand grinder and then by a nanomizer, to provide an aqueous dispersion containing 10% by dry solid weight of the silica particles having an average secondary particle size of 80 nm. The aqueous dispersion in an amount of 100 parts by dry solid weight was mixed with 10 parts by dry solid weight of a cationic resin consisting of diallyldimethyl quaternary ammonium-hydrochloric acid salt (trademark: UNISENCE CP-103, made by SENKA K.K.), to cause the pigment particles to agglomerate with each other through the cationic resin and the pigment dispersion to be thickened. Then, the pigment dispersion was subjected to repeated pulverization and dispersion procedures using the nanomizer, to prepare an aqueous silica dispersion (fine pigment particles C2-II) containing 8% by dry solid weight of the agglomerated silica particles having an average secondary particle size of 250 nm.

Fine Pigment Particles D-II

Alumina particles (trademark: AKP-G015, γ-alumina, by TOKUYAMA K.K.) having an average secondary particle size of about 2 μm were repeatedly dispersed and pulverized in water by using a sand grinder and then by a microfluidizer, to provide an aqueous dispersion (fine pigment particles D-II) containing 10% by dry solid weight of the alumina particles having an average secondary particle size of 130 nm.

Example II-1

An ink jet recording material of the present invention was produced by coating substrate sheet B-II with a coating liquid II-(1) having the composition shown below by a die coater to form an image recording stratum in a dry solid amount of 5 g/m$^2$.

Coating Liquid II-(1)

Coating liquid II-(1) was an aqueous coating liquid containing a mixture of 100 parts by dry solid weight of fine pigment particles C2-II, 35 parts by dry solid weight of a silyl-modified polyvinyl alcohol (trademark: PVA R-1130, made by KURARAY K.K.) and 5 parts by dry solid weight of pyrocatechol-3,5-disulfonate sodium salt (this is called "TIRON", and made by KANTO KAGAKU K.K.), and having a total dry solid content of 8% by weight.

Example II-2

An ink jet recording material was produced by the same procedures as in Example I-24 with the following exception.

Before the ink receiving layer was formed from the coating liquid II-(1), the front surface of the substrate sheet B-II was coated with a coating liquid II-(2), having the composition as shown below, by a die coater and dried to form an ink receiving inside layer in a dry solid amount of 15 g/m$^2$. Then, the ink receiving layer surface was coated by the coating liquid II-(1) and dried to form an ink receiving outermost layer in a dry solid amount of 5 g/m$^2$.

Coating Liquid II-(2)

This coating liquid was an aqueous coating liquid containing a mixture of 100 parts by dry solid weight of gel method silica particles (trademark: SYLOJET P403, made by GRACE DAVISON CO.) having an average primary particle size of about 13 nm and an average secondary particle size of 3 μm with 35 parts by dry solid weight of a silyl-modified polyvinyl alcohol (trademark: PVA R-1130, made by KURARY K.K.) and having a total dry solid content of 15% by weight.

Example II-3

An ink jet recording material was produced by the same procedures as in Example II-2 with the following exception.

The substrate sheet B-II was replaced by substrate sheet C-II.

Example II-4

An ink jet recording material was produced by the following procedures.

A polyethylene terephthalate (PET) film (trademark: LUMIRROR-T, made by TORAY K.K.) having a thickness of 50 μm was coated with the same coating liquid as the coating liquid II-(1), except that the pyrocatechol-3,5-disulfonate sodium salt was replaced by sodium salicylate (made by KANTO KAGAKU K.K.) by using a die coater, and dried to form an ink receiving outermost layer in an dry solid amount of 5 g/m$^2$. The ink receiving outermost layer was coated by the coating liquid II-(2) by using a die coater and dried to form an ink receiving inside upper layer in a dry solid amount of 15 g/m$^2$. Separately, a front surface of substrate sheet B-II was coated with the coating liquid II-(2) for forming an ink receiving inside under layer, in a dry solid amount of 10 g/m$^2$ by using a bar coater, and the surface of the coating liquid (2) layer on the substrate sheet (B)-II was superposed on the surface of the ink receiving inside upper layer on the PET film and dried to bond the resultant ink receiving inside under layer to the ink receiving inside upper layer. Then, the PET film was peeled off from the ink receiving outermost layer. The resultant ink jet recording material contained a recording stratum formed on the substrate sheet B-II and consisting of three ink receiving layers.

Example II-5

An ink jet recording material was produced by the same procedures as in Example II-3 with the following exception.

The coating liquid II-(1) further contained 3 parts by dry solid weight of calcium chloride.

Example II-6

An ink jet recording material was produced by the same procedures as in Example II-3 with the following exceptions.

The coating liquid II-(2) used in Example II-3 was replaced by a coating liquid II-(3) having the composition mentioned below.

Coating Liquid II-(3)

This coating liquid II-(3) is an aqueous coating liquid containing a mixture of 100 parts by dry solid weight of gel method silica particles (trademark: SYLOJET 703A, made by GRACE DAVISON CO.) having an average primary particle size of about 10 to 15 nm and an average secondary particle size of 300 nm with 25 parts by dry solid weight of a polyvinyl alcohol (trademark: PVA-140H, made by KURARY K.K.), and 10 parts by dry solid weight of p-hydroxybenzenesulfonate sodium salt (made by KANTO KAGAKU K.K.) and having a total dry solid content of 15% by weight.

Also, the coating liquid II-(1) used in Example II-3 was replaced by a coating liquid II-(4) having the composition as shown below.

Coating Liquid II-(4)

Coating liquid II-(4) was an aqueous coating liquid containing a mixture of 100 parts by dry solid weight of the fine pigment particles C2-II with 35 parts by dry solid weight of a silyl-modified polyvinyl alcohol (trademark: PVA R-1130, made by KURARY K.K.), and 7 parts by dry solid weight of p-hydroxybenzenesulfonate sodium salt (made by KANTO KAGAKU K.K.) and having a total dry solid content of 8% by weight.

Example II-7

An ink jet recording material was produced by the same procedures as in Example II-6 with the following exception.

In the coating liquid II-(3) used in Example II-6, the gel method silica particles were replaced by alumina-modified gel method silica particles (trademark: WSSG-1CA, made by GRACE DAVISON CO.) having an average secondary particle size of 1 μm.

Example II-8

An ink jet recording material was produced by the same procedures as in Example II-6 with the following exceptions.

The substrate sheet C-II was replaced by a polypropylene synthetic paper sheet (trademark: GWG-140, made by OJI YUKAGOSEISHI K.K.), and 10 parts by dry solid weight of the p-hydroxybenzenesulfonate sodium salt contained in each of the coating liquid II-(3) and II-(4) was replaced by 15 parts by dry solid weight of arbutin (made by TOKYO KASEIKOGYO K.K.)

Comparative Example II-1

An ink jet recording material was produced by the same procedures as in Example II-3 with the following exception.

In the coating liquid II-(1), no TIRON was contained.

Comparative Example II-2

An ink jet recording material was produced by the same procedures as in Example II-3 with the following exception.

In the coating liquid II-(1), the fine pigment particle C2-II were replaced by the fine pigment particles A3-II.

Comparative Example II-3

An ink jet recording material was produced by the same procedures as in Example II-3 with the following exception.

In the coating liquid II-(1), the TIRON was replaced by an ultraviolet ray-absorbing benzotriazole compound (trademark: JF-77, made by JOHOKU KAGAKU K.K.)

Comparative Example II-4

An ink jet recording material was produced by the same procedures as in Example II-3 with the following exception.

In the coating liquid II-(1), the TIRON was replaced by a hindered amine type photostabilizer (trademark: TINUVIN 144, made by CIBA-GEIGY).

Comparative Example II-5

An ink jet recording material was produced by the same procedures as in Example II-3 with the following exception.

In the preparation of the fine pigment particles C2-II, after the cationic acid was added, the resultant dispersion was pulverized and dispersed to such an extent that the resultant particles had an average secondary particle size of 700 nm.

Tests

Each of the ink jet recording materials of Examples II-1 to II-8 and Comparative Examples II-1 to II-5 were subjected to the tests and evaluations of ink absorption, color density of recorded image, gloss of recorded images, light resistance of recorded images, and water resistance of recorded images, by the following methods.

The recording material was printed by using an ink jet printer (model: PM-770C, made by EPSON K.K.)

Ink Absorption

A sample of the recording material having dimensions of 10 cm×10 cm was attached to a center portion of an A size woodfree paper sheet, and solid printed with a black-coloring ink in an amount of 15 g/m$^2$, and blotting of the ink from the solid ink print was observed by the naked eye. A woodfree paper sheet was superposed on the solid printed sample, and an ink-absorbing time after which no ink was transferred from the sample to the superposed woodfree paper sheet namely within which the ink applied to the sample was completely absorbed in the sample, was measured.

| Class | Ink absorbing time |
|---|---|
| 4 | Less than one second. |
| 3 | One second or more but less than 5 seconds. |
| 2 | Five seconds or more but less than one minute. |
| 1 | One minute or more. |

Color Density of Recorded Images

The color density of the solid images of the black-coloring ink was measured by a Macbeth reflection color density meter (model: RD-914, made by Macbeth)

Gloss of Recorded Images

The gloss of recorded images was evaluated at an angle of 20° from the image-recorded surface by the naked eye.

| Class | Gloss |
|---|---|
| 4 | Excellent gloss comparable to color photograph. |
| 3 | High gloss but slightly lower than color photograph. |
| 2 | Glossy. |
| 1 | Poor gloss. |

Light Resistance of Recorded Images

On the recording material, images in accordance with GRAPHIC TECHNOLOGY-PREPRESS DIGITAL DATA EXCHANGE-STANDARD COLOUR IMAGE DATA (SCID), N1A, Portrait, were printed by using an ink jet printer (model: PM-770C, made by EPSON K.K.).

The printed images were subjected to a continuous light resistance test using a Xenon lamp type FADE-O-METER (model: Ci35F, made by ATLAS ELECTRIC DEVICES CO.) under conditions of 63° C. and 50% RH for 50 hours. The tested images were compared with the non-tested images and the light resistance of the images were evaluated as follows.

| Class | Fade |
|---|---|
| 4 | Substantially no fading was found. |
| 3 | Slight fading appeared. Practically usable. |
| 2 | Fading appeared and slight loss of color balance is found. Practically usable. |
| 1 | Significant fading appears and significant loss of color balance is found. Practically not usable. |

Water Resistance of Recorded Images

The images recorded on the recording material was stored for 24 hours. Then a water drop was dropped on the images, and one minute after the water-dropping, the water was wiped off. The water-wetted portions of the images were observed by the naked eye and evaluated as follows.

| Class | Blotting of ink |
|---|---|
| 4 | No blotting of ink is found. Excellent water resistance. |
| 3 | Slight blotting of ink is found. Good water resistance. |
| 2 | Blotting of ink is found. Practically usable. |
| 1 | Significant blotting of ink occurs. Practically not usable. |

The test results are shown in Table 4.

TABLE 4

| Item | Example No. | Ink absorption | Recorded images: Color density | Gloss | Light resistance | Water resistance |
|---|---|---|---|---|---|---|
| Example | II-1 | 2 | 2.25 | 3 | 3 | 3 |
| | II-2 | 4 | 2.10 | 2 | 3 | 3 |
| | II-3 | 4 | 2.15 | 3 | 3 | 3 |
| | II-4 | 4 | 2.45 | 4 | 2 | 3 |
| | II-5 | 4 | 2.10 | 3 | 4 | 3 |
| | II-6 | 4 | 2.35 | 4 | 4 | 3 |
| | II-7 | 3 | 2.25 | 4 | 4 | 4 |
| | II-8 | 4 | 2.35 | 4 | 3 | 3 |
| Comparative Example | II-1 | 4 | 2.30 | 3 | 1 | 3 |
| | II-2 | 4 | 1.85 | 1 | 4 | 3 |
| | II-3 | 2 | 1.95 | 2 | 1 | 3 |
| | II-4 | 2 | 2.00 | 2 | 1 | 3 |
| | II-5 | 4 | 1.55 | 1 | 4 | 3 |

Table 4 clearly shows that the ink jet recording materials of the Examples II-1 to II-8 in which fumed silica particles having an average secondary particle size of 300 nm and a phenol compound are contained in the recording stratum, exhibited high color density, high gloss and high resistance to light and water resistance of the recorded images. Particularly, the ink jet recording materials of Examples II-2 to II-8 in which the recording stratum is consisted of a plurality of ink receiving layers, exhibited a high ink absorption and a high clarity of the ink images. Also, Examples II-1 to II-3 and II-5 to II-8 in which, as a phenolic compound, a hydroquinone derivative, a pyrocatechol derivative or a phenol-sulfonate salt was contained, exhibited a high color resistance of the recorded images.

The comparative ink jet recording materials of Comparative Example II-1 in which no image light resistance-enhancing agent was employed, Comparative Example II-3 in which a conventional ultraviolet ray absorber was employed, Comparative Example II-4 in which a photostabilizer was employed exhibited a unsatisfactory light resistance of the recorded images. Also, the comparative ink jet recording materials of Comparative Example II-2 in which no fumed silica was employed, Comparative Example II-5 in which fumed silica particles having an average secondary particle size of more than 300 nm were employed, exhibited very poor color density and gloss of the recorded images, and thus in the comparative examples, the target ink jet recording materials of the present invention could not be obtained.

Examples II-9 to II-12

In each of Examples II-9 to II-12, a front surface of a substrate sheet C-II was coated with a coating liquid II-(5) having the composition as shown below in a dry solid amount of 20 g/m$^2$ by using a die coater, and dried to form an ink receiving inside layer. Then the ink receiving inside layer surface coated with a coating liquid II-(6) having the composition as shown below in a dry solid amount of 6 g/m$^2$ by using a die coater, to form an ink receiving outermost layer.

| Coating liquid II-(5) (dry solid content: 12% by weight) | |
|---|---|
| Component | Parts by dry solid weight |
| Fine silica pigment particles B-II | 100 |
| Polyvinyl alcohol (trademark: PVA 135, made by KURARAY) | 17 |

| Coating liquid II-(6) (dry solid content: 10% by weight) | |
|---|---|
| Component | Parts by dry solid weight |
| Fine silica pigment particles C1-II | 100 |
| Polyvinyl alcohol (trademark: PVA 135, made by KURARAY) | 15 |

Then, the ink receiving outermost layer surface was impregnated with an aqueous solution containing 4% by weight of boric acid in a coating dry solid amount of 0.25 g/m$^2$ in Example II-9, 0.5 g/m$^2$ in Example II-10, 1.0 g/m$^2$ in Example II-11 and 5.0 g/m$^2$ in Example II-12, by using a bar coater, and dried to form a boric acid-containing ink receiving outermost layer.

Example II-13

An ink jet recording material was produced by the same procedures as in Example II-9 with the following exception.

The coating liquid II-(6) was replaced by a coating liquid II-(7) having the composition as shown below.

| Coating liquid II-(7) (dry solid content: 7% by weight) | |
|---|---|
| Component | Parts by dry solid weight |
| Fine silica pigment particles C-II | 100 |
| Polyvinyl alcohol (trademark: PVA 135, made by KURARAY) | 15 |
| Boric acid | 0.25 |

The impregnating procedure for the ink receiving outermost layer with the boric acid-containing aqueous solution was omitted.

Example II-14

An ink jet recording material was produced by the same procedures as in Example II-9 with the following exception.

The boric acid-containing aqueous solution for the ink receiving outermost layer was replaced by an aqueous solution of 4% by dry solid weight of borax (sodium tetraborate hydrate, and the borax solution $Na_2[B_4O_5(OH)_4].8H_2O$, and the borax solution was impregnated in a dry solid coating amount of 0.5 g/m$^2$ on the ink receiving outermost layer by using a bar coater, and dried.

Examples II-15 to II-18

In each of Examples II-15 to II-18, an ink jet recording material was produced by the same procedures as in Example with the following exception.

The boric acid containing coating liquid for the ink receiving outermost layer was replaced by an aqueous solution of 10% by dry solid weight of γ-cyclodextrin. The γ-cyclodextrin solution was impregnated in a dry solid coating amount of 0.25 g/m$^2$ in Example II-15, 0.5 g/m$^2$ in Example II-16, 1.0 g/m$^2$ in Example II-17 and 5.0 g/m$^2$ in Example II-18, in the ink receiving outermost layer by using a bar coater, and dried.

Example II-19

An ink jet recording material was produced by the same procedures as in Example II-9 with the following exception.

The coating liquid II-(6) was replaced by a coating liquid II-(8) having the composition as shown below.

Coating liquid II-(8) (dry solid content: 10% by weight

| Component | Parts by dry solid weight |
|---|---|
| Fine silica pigment particles C-II | 100 |
| Polyvinyl alcohol (trademark: PVA 135, made by KURARAY) | 15 |
| γ-cyclodextrin | 1.0 |

The impregnating procedure for the ink receiving outermost layer with the boric acid-containing aqueous solution was omitted.

Example II-20

An ink jet recording material was produced by the same procedures as in Example II-9 with the following exception.

The boric acid-containing aqueous solution was replaced by an aqueous solution containing 1% by dry solid weight of β-cyclodextrin. The β-cyclodextrin solution was impregnated in a dry solid coating amount of 0.25 g/m$^2$ by using a bar coater in the ink receiving outermost layer, and dried.

Example II-21

A front surface of substrate sheet A-II was coated with a coating liquid II-(9) having the composition as shown below in a dry solid amount of 10 g/m$^2$ by using an air knife coater, and dried to form an ink receiving inside under layer. Then the inside under layer was coated with a coating liquid II-(10) having the composition as shown below in a dry solid amount of 5 g/m$^2$ by using an air knife coater, and dried to form an ink receiving inside upper layer. The inside upper layer was coated with an coating liquid II-(11) having the composition as shown below in a dry solid amount of 3 g/m$^2$ by using a roll coater, the resultant coating liquid II-(11) layer was brought into contact, under pressure, with a mirror-finished peripheral surface of a casting drum at a peripheral surface temperature of 95° C., dried, and separated from the casting drum.

Coating liquid II-(9) (dry solid content: 15% by weight

| Component | Parts by dry solid weight |
|---|---|
| Synthetic silica particles (trademark: FINESIL X-60, made by TOKUYAMA K.K., average secondary particle size: 6.0 μm average primary particle size: 15 nm) | 70 |
| Zeolite particles (trademark: TOYO BUILDER, made by TOSO K.K., average particle size: 1.5 μm) | 30 |
| Silyl-modified polyvinyl alcohol (trademark: PVA-R1130, made by KURARAY) | 20 |

Coating liquid II-(10) (dry solid content: 12% by weight

| Component | Parts by dry solid weight |
|---|---|
| Fine silica pigment particles A-II | 100 |
| Polyvinyl alcohol (trademark: PVA 135, made by KURARAY) | 15 |

Coating liquid II-(11) (dry solid content: 12% by weight

| Component | Parts by dry solid weight |
|---|---|
| Fine silica pigment particles A-II | 100 |
| Polyvinyl alcohol (trademark: PVA 135, made by KURARAY) | 25 |
| Stearic acid amide | 2 |

The ink receiving outermost layer was impregnated with an aqueous solution of 4% by dry solid weight of boric acid in a dry solid amount of 1.0 g/m$^2$, by using a bar coater, and dried.

The resultant ink jet recording material had a high gloss.

Example II-22

An ink jet recording material was produced by the same procedures as in Example II-21 with the following exceptions.

The 4% aqueous boric acid solution was replaced by an aqueous solution of 10% by dry solid weight of γ-cyclodextrin, and the dry solid amount of the γ-cyclodextrin impregnated in the outermost layer was by using a bar coater 1.0 g/m$^2$.

Example II-23

A front surface of substrate sheet A-II was coated with a coating liquid II-(12) having the composition as shown below in a dry solid amount of 12 g/m$^2$ by using an air knife coater and dried to form an ink receiving inside layer. The ink receiving inside layer surface was coated with a coating liquid II-(13) having the composition as shown below in a dry solid amount of 6 g/m$^2$ by using an air knife coater, and semi-dried with cold air blast for 20 seconds. The semi-dried coating liquid II-(13) layer having a water content of 150% based on the absolute dry weight of the layer was brought into contact under pressure with a mirror-finished peripheral surface of a casting drum at a peripheral surface temperature of 100° C., fully dried to form an ink receiving outermost layer. The dried outermost layer was separated from the casting drum.

Coating liquid II-(12) (dry solid content: 15% by weight

| Component | Parts by dry solid weight |
|---|---|
| Synthetic silica particles (trademark: FINESIL X-60, made by TOKUYAMA, average secondary particle size: 60 μm average primary particle size: 15 μm) | 70 |
| Zeolite particles (trademark: TOYO BUILDER, made by TOSO K.K., average particle size: 1.5 μm) | 30 |
| Silyl-modified polyvinyl alcohol (trademark: PVA R1130, made by KURARAY) | 20 |

Coating liquid II-(13) (dry solid content: 12% by weight

| Component | Parts by dry solid weight |
|---|---|
| Fine silica pigment particles A1-II | 100 |
| Polyvinyl alcohol (trademark: PVA 117, made by KURARAY) | 15 |
| Stearic acid amide | 2 |

The ink receiving outermost layer was impregnated with an aqueous solution of 4% by dry solid weight of boric acid in a dry solid amount of 1.0 g/m$^2$ by using a bar coater, and dried to provide a boric acid-containing ink receiving outermost layer having a high gloss.

Example II-24

An ink jet recording material was produced by the same procedures as in Example II-23 with the following exception.

The ink receiving outermost layer was impregnated with an aqueous solution of 10% by dry solid weight of γ-cyclodextrin in a dry solid amount of 1.0 g/m$^2$ by using a bar coater, and dried.

Example II-25

An ink jet recording material was produced by the following procedures.

A surface of a casting base film consisting of a PET film (trademark: LUMIRROR-T, made by TORAY K.K.) having a thickness of 50 μm was coated with a coating liquid II-(14) having the composition as shown below in a dry solid amount of 5 g/m$^2$ by using a die coater and dried to form an ink receiving outermost layer.

The ink receiving outermost layer was coated with a coating liquid II-(15) having the composition as shown below in a dry weight amount of 10 g/m$^2$ and dried to form an ink receiving inside upper layer.

Coating liquid II-(14) (dry solid content: 10% by weight

| Component | Parts by dry solid weight |
|---|---|
| Fine silica pigment particles A1-II | 100 |
| Polyvinyl alcohol (trademark: PVA 135, made by KURARAY) | 15 |

Coating liquid II-(15) (dry solid content: 12% by weight

| Component | Parts by dry solid weight |
|---|---|
| Fine silica pigment particles B-II | 100 |
| Polyvinyl alcohol (trademark: PVA 135, made by KURARAY) | 17 |

Separately, a front surface of a substrate sheet B-II was coated with the coating liquid II-(15) in a dry solid amount of 2 g/m$^2$ by using a bar coater, and the coating liquid II-(15) layer on the substrate sheet B-II was superposed on the ink receiving inside upper layer on the PET Film and dried to bond the resultant ink receiving inside under layer to the ink receiving inside upper layer. Then, the PET film was peeled off from the ink receiving outermost layer.

An ink jet recording material having a recording stratum consisting of ink receiving inside under and upper and outermost layers.

Example II-26

An ink jet recording material was produced by the same procedures as in Example II-25 with the following exceptions.

After the PET film was coated with the coating liquid II-(14) and dried, the resultant ink receiving inside upper layer was coated with an aqueous solution of 10% by dry solid weight of γ-cyclodextrin in a dry solid amount of 1.0 g/m$^2$ by using a bar coater, and while the coated γ-cyclodextrin solution layer is kept undried, the coating liquid II-(15) for the ink receiving outermost layer was coated by using a bar coater and dried.

Example II-27

An ink jet recording material was produced by the following procedures.

A front surface of substrate sheet A-II was coated with a coating liquid II-(16) having the composition as shown below in a dry solid amount of 10 g/m$^2$ by using an air knife coater and dried to form an ink receiving inside under layer.

Coating liquid II-(16) (dry solid content: 18% by weight

| Component | Parts by dry solid weight |
|---|---|
| Synthetic silica particles (trademark: FINESIL X-60, made by TOKUYAMA K.K., average secondary particle size: 6.0 μm average primary particle size: 15 μm) | 100 |

-continued

Coating liquid II-(16) (dry solid content: 18% by weight

| Component | Parts by dry solid weight |
|---|---|
| Silyl-modified polyvinyl alcohol (trademark: PVA R1130, made by KURARAY) | 20 |
| Cationic resin (trademark: CP103, made by SENKA K.K) | 15 |
| Cationic resin (trademark: NEOFIX E117, made by NICCA KAGAKU K.K) | 5 |

The resultant ink receiving inside layer was coated with a coating liquid II-(17) having the composition as shown below in a dry solid amount of 8 g/m$^2$ by using a roll coater, and while the coating liquid II-(17) layer is kept undried, the coating liquid II-(17) layer was brought into contact under pressure with a mirror-finished peripheral surface of a casting drum at a peripheral surface temperature of 85° C. and dried to form an ink receiving outermost layer.

The ink receiving outermost layer was peeled off from the casting drum.

Coating liquid II-(17) (dry solid content: 25% by weight

| Component | Parts by dry solid weight |
|---|---|
| Emulsion of styrene-2-methyl-hexyl acrylate copolymer having a glass transition temperature of 75° C. and an average particle size of 40 nm | 30 |
| Colloidal silica having an average particle size of 30 nm | 70 |
| Thickening and dispersing agent (alkylvinylether-maleic acid derivative copolymer) | 5 |
| Releasing agent (lecithin) | 1.5 |

The ink receiving outermost layer was coated with an aqueous solution of 4% by dry solid weight of boric acid by using a bar coater and dried, to impregnate boric acid solution in a dry solid amount of 1.0 g/m$^2$ therein.

Example II-28

An ink jet recording material was produced by the same procedures as in Example II-27 with the following exceptions.

The ink receiving outermost layer was coated with an aqueous solution of 10% by dry solid weight of γ-cyclodextrin by using a bar coater to impregnate the γ-cyclodextrin in a dry solid amount of 1.0 g/m$^2$ therein, and dried.

Example II-29

An ink jet recording material was produced by the following procedures.

A front surface of a substrate sheet C-II was coated with a coating liquid II-(18) having the composition as shown below in a dry solid amount of 20 g/m$^2$ by using a die coater and dried to form an ink receiving inside layer.

Coating liquid II-(18) (dry solid content: 12% by weight

| Component | Parts by dry solid weight |
|---|---|
| Fine silica pigment particles B-II | 100 |
| Polyvinyl alcohol (trademark: PVA 135, made by KURARAY) | 17 |

The ink receiving outermost layer was coated with a coating liquid II-(19) having the composition as shown below in a dry solid amount of 6 g/m$^2$ by using a die coater, and dried to form an ink receiving outermost layer.

Coating liquid II-(19) (dry solid content: 10% by weight

| Component | Parts by dry solid weight |
|---|---|
| Fine silica pigment particles D-II | 100 |
| Polyvinyl alcohol (trademark: PVA 135, made by KURARAY) | 15 |

The ink receiving outermost layer was coated with an aqueous solution of 4% dry solid weight of boric acid by using a die coater and dried, to impregnate boric acid solution in a dry solid amount of 1.0 g/m$^2$, in the outermost layer.

Example II-30

An ink jet recording material was produced by the same procedures as in Example II-29 with the following exception.

In the place of the aqueous boric acid solution, an aqueous solution of 10% by dry solid weight of γ-cyclodextrin was coated in a dry solid amount of 1.0 g/m$^2$ on the ink receiving outermost layer by using a bar coater to allow the γ-cyclodextrin to be impregnated in the outermost layer.

Example II-31

An ink jet recording material was produced by the same procedures as in Example II-29 with the following exception.

In the coating liquid II-(19) for the ink receiving outermost layer, the fine alumina pigment particles D-II was replaced by fine silica pigment particles A1-II.

Example II-32

An ink jet recording material was produced by the same procedures as in Example II-30 with the following exception.

In the coating liquid II-(19) for the ink receiving outermost layer, the fine alumina pigment particles D-II was replaced by fine silica pigment particles A1-II.

Example II-33

An ink jet recording material was produced by the same procedures as in Example II-29 with the following exception.

In the coating liquid II-(19) for the ink receiving outermost layer, the fine alumina pigment particles D-II was replaced by fine silica pigment particles A2-II.

Example II-34

An ink jet recording material was produced by the same procedures as in Example II-30 with the following exception.

In the coating liquid II-(19) for the ink receiving outermost layer, the fine alumina pigment particles D-II was replaced by fine silica pigment particles A2-II.

Comparative Example II-6

An ink jet recording material was produced by the following procedures.

A front surface of a substrate sheet A-II was coated with a coating liquid II-(16) having the composition as shown below in a dry solid amount of 10 g/m$^2$ by using an air knife coater and dried to form a recording stratum.

Comparative Example II-7

The substrate sheet B-II per se was employed as an ink jet recording material.

Tests

The ink jet recording materials of Examples II-9 to 34 and Comparative Examples 6 to 7 were subjected to the tests on the light resistance, color density and water resistance of the recorded images.

The image recording was carried out by using an ink jet printer (1) (model: PM-750C, made by EPSON K.K.)

For the images for the light resistance test, an ink jet printer (2) (model: DJ970Cxi, made by HEWLETT PACKARD CO.) was employed.

Light Resistance of Recorded Images

The images of ISO-400 ("GRAPHIC TECHNOLOGY-PREPRESS DIGITAL DATA EXCHANGE-STANDARD COLOUR IMAGE DATA (SCID)", page 13, Image name: Fruit basket and page 14, Image name: Candle, published by Juridical Foundation, NIHON KIKAKU KYOKAI) were printed in a glossy sheet mode on the ink jet recording material by using the ink jet printers (1) and (2). The resultant two types of prints were subjected to a fading test using a xenon lamp type Fade-O-Meter (ATLAS ELECTRIC DEVICES CO., model: Ci135F) at a temperature of 63° C., at a relative humidity of 50% for 50 hours.

The tested images were compared with the non-tested images and the light resistance of the images was evaluated in the following 8 classes.

| Class | light resistance |
|---|---|
| 8 | Substantially no fading is found. |
| 7 | Very slight fading is found. |
| 6 | Slight fading is found. |
| 5 | Certain fading is found. |
| 4 | Fading and loss in color balance are found.<br>Practically usable. |
| 3 | Fading and loss in color balance are more than class 4. |
| 2 | Significant fading and loss in color balance are found.<br>Practically not usable. |
| 1 | Very significant fading is found. |

Uniformity of Solid Image

A cyan-coloring ink-and magenta-coloring ink mixture solid image was printed on the recording material by using the printer (1), and uniformity of the solid image was evaluated by the naked eye in the following five classes.

| Class | Uniformity of solid image |
|---|---|
| 5 | Completely uniform.<br>Extremely good. |
| 4 | Substantially uniform.<br>Good. |
| 3 | Slightly uneven.<br>Substantially no problem in practice. |
| 2 | Uneven.<br>Practically poor usability |
| 1 | Very uneven.<br>Practically not usable. |

Blotting of Recorded Images

Four colored solid images with a black coloring ink, a cyan-coloring ink, a magenta-coloring ink and a yellow-coloring inks were printed on the recording sheet by using the printer (1) in such a manner that the four-colored solid images are connected at the circumferences thereof with each other, and the ink-blottings in the boundaries of the solid images with each other is observed and evaluated by the naked eye in the following five classes.

| Class | Ink blotting |
|---|---|
| 5 | No ink blotting is found.<br>Excellent. |
| 4 | Substantially no ink blotting is found.<br>Excellent. |
| 3 | Slight ink blotting is found.<br>Practically substantially no problem. |
| 2 | Ink blotting is certainly found.<br>Slight problem occurs in practice. |
| 1 | Significant ink blotting is found.<br>Practically not usable. |

Color Density of Recorded Images

A black-colored solid images printed on the recorded material by using the ink jet printer (1) was subjected to a measurement of color density by using a Macbeth reflection color density meter (model: RD-920, made by Macbeth).

The measurement was repeated three times and an average value of the measurement data was calculated.

Water Resistance of Recorded Images

Ink images were printed on the recording material by the printer (1), the printed images were stored for 24 hours. A water drop was dropped on the ink images, and one minute after the water dropping, the water was wiped off from the images, and the conditions of the water-wetted images was observed and evaluated by the naked eye in the following four classes.

| Class | Water resistance |
|---|---|
| 4 | Substantially no ink was removed. |
| 3 | Ink was slightly removed.<br>Practically no problem. |
| 2 | Ink was practically removed.<br>Practically usable.. |
| 1 | Ink was significantly removed.<br>practically not usable. |

White Sheet Gloss

A 75° specular gloss of non-printed portion of the recording material was measured in accordance with JIS P 8142.

The test results are shown in Tables 5 and 6.

TABLE 5

| | | Item | | | | | | | | | | |
|---|---|---|---|---|---|---|---|---|---|---|---|---|
| | | Type | Image light resistance-enhancing agent | | | Recorded images | | | | | | |
| | | of sub-strate | | Applica-tion | Dry solid content | Light resistance Printer | | Unifor- | Resistance to | Color | Water | 75° specular gloss |
| Example No. | | sheet | Type | method | (g/m$^2$) | (1) | (2) | mity | blotting | density | resistance | (%) |
| Example | II-9 | C-II | Boric acid | Impregnation | 0.25 | 6 | 6 | 5 | 5 | 2.45 | 4 | 50 |
| | II-10 | C-II | Boric acid | Impregnation | 0.5 | 8 | 8 | 5 | 5 | 2.40 | 4 | 50 |
| | II-11 | C-II | Boric acid | Impregnation | 1.0 | 8 | 8 | 4 | 4 | 2.35 | 4 | 50 |
| | II-12 | C-II | Boric acid | Impregnation | 5.0 | 8 | 8 | 3 | 3 | 2.20 | 4 | 40 |
| | II-13 | C-II | Boric acid | Mixing | 0.25 | 5 | 5 | 5 | 5 | 2.40 | 4 | 40 |
| | II-14 | C-II | Borax acid | Impregnation | 0.5 | 6 | 6 | 5 | 5 | 2.40 | 4 | 50 |
| | II-15 | C-II | γ-CD | Impregnation | 0.25 | 3 | 4 | 5 | 5 | 2.45 | 4 | 50 |
| | II-16 | C-II | γ-CD | Impregnation | 0.5 | 5 | 6 | 5 | 5 | 2.40 | 4 | 50 |
| | II-17 | C-II | γ-CD | Impregnation | 1.0 | 6 | 8 | 3 | 3 | 2.35 | 3 | 50 |
| | II-18 | C-II | γ-CD | Impregnation | 5.0 | 6 | 8 | 2 | 2 | 2.20 | 2 | 50 |
| | II-19 | C-II | γ-CD | Mixing | 1.0 | 6 | 8 | 3 | 3 | 2.30 | 2 | 45 |
| | II-20 | C-II | β-CD | Impregnation | 0.25 | 3 | 4 | 5 | 5 | 2.40 | 4 | 50 |
| | II-21 | A-II | Boric acid | Impregnation | 1.0 | 8 | 8 | 5 | 5 | 2.20 | 3 | 70 |
| | II-22 | A-II | γ-CD | Impregnation | 1.0 | 6 | 8 | 5 | 5 | 2.20 | 3 | 70 |

Note: γ-CD: γ-cyclodextrin
β-CD: β-cyclodextrin

TABLE 6

| | | Item | | | | | | | | | | |
|---|---|---|---|---|---|---|---|---|---|---|---|---|
| | | Type | Image light resistance-enhancing agent | | | Recorded images | | | | | | |
| | | of sub-strate | | Applica-tion | Dry solid content | Light resistance Printer | | Unifor- | Resistance to | Color | Water | 75° specular gloss |
| Example No. | | sheet | Type | method | (g/m$^2$) | (1) | (2) | mity | blotting | density | resistance | (%) |
| Example | II-23 | A-II | Boric acid | Impregnation | 1.0 | 8 | 8 | 5 | 5 | 2.10 | 4 | 75 |
| | II-24 | A-II | γ-CD | Impregnation | 1.0 | 6 | 8 | 5 | 5 | 2.10 | 4 | 75 |
| | II-25 | B-II | Boric acid | Impregnation | 1.0 | 8 | 8 | 5 | 5 | 2.55 | 4 | 75 |
| | II-26 | B-II | γ-CD | Impregnation | 1.0 | 6 | 8 | 5 | 5 | 2.55 | 4 | 75 |
| | II-27 | B-II | Boric acid | Impregnation | 1.0 | 8 | 8 | 5 | 5 | 1.85 | 4 | 70 |
| | II-28 | B-II | γ-CD | Impregnation | 1.0 | 6 | 8 | 5 | 5 | 1.85 | 4 | 70 |
| | II-29 | C-II | Boric acid | Impregnation | 1.0 | 8 | 8 | 5 | 5 | 2.50 | 3 | 70 |
| | II-30 | C-II | γ-CD | Impregnation | 1.0 | 6 | 8 | 5 | 5 | 2.50 | 3 | 70 |
| | II-31 | C-II | Boric acid | Impregnation | 1.0 | 8 | 8 | 5 | 5 | 2.25 | 3 | 40 |
| | II-32 | C-II | γ-CD | Impregnation | 1.0 | 6 | 8 | 5 | 5 | 2.25 | 3 | 40 |
| | II-33 | C-II | Boric acid | Impregnation | 1.0 | 8 | 8 | 5 | 5 | 2.00 | 3 | 30 |
| | II-34 | C-II | γ-CD | Impregnation | 1.0 | 6 | 8 | 5 | 5 | 2.00 | 3 | 30 |
| Compara-tive Example | II-6 | A-II | — | — | 0 | 4 | 4 | 5 | 5 | 1.55 | 4 | 5 |
| | II-7 | A-II | — | — | 0 | 3 | 3 | 1 | 1 | 1.25 | 1 | 8 |

Note: γ-CD: γ-cyclodextrin
β-CD: β-cyclodextrin

Tables 5 and 6 clearly show that the ink jet recording materials of Examples II-9 to II-34 exhibited a high light resistance of the recorded images and satisfactory color density, uniformity, resistance to ink blotting and water resistance of the recorded images.

As mentioned above, the ink jet recording material of the present invention has a high ink image-recording performance and optionally a high light resistance of the recorded images.

What is claimed is:

1. An ink jet recording material comprising:

a substrate, and an image-recording stratum located on at least one surface of the substrate, formed from at least one ink receiving layer and comprising a binder and a plurality of pigment particles dispersed in the binder, at least one ink receiving layer of the image-recording stratum comprising fine particles of at least one pigment selected from the group consisting of θ-, δ- and γ-aluminas in the form of secondary particles having an average secondary particle size of 500 nm or less, and consisting of a plurality of primary particles agglomerated with each other, wherein the fine particles of the alumina compounds have a BET specific area of 50 to 300 m2/g and a pore volume of 0.2 to 1.0 ml/g.

2. The ink jet recording material as claimed in claim 1, wherein at least one ink receiving layer of the image-recording stratum comprises fine particles of at least one silica compound having an average particle size of 1 $\mu$m or less.

3. The ink jet recording material as claimed in claim 2, wherein the silica compound contained in the ink image-recording layer is contained in the form of secondary particles having a average secondary particle size of 500 nm or less, each of the secondary particles consisting of an agglomerate of a plurality of primary particles, having an average primary particle size of 3 to 40 nm, with each other.

4. The ink jet recording material as claimed in any one of claims 1, 2 and 3, wherein the fine particles of silica are fine particles of fumed silica.

5. The ink jet recording material as claimed in claim 1 or 2, wherein the image-recording stratum has at least one ink receiving inside layer formed on the substrate and an ink receiving outermost layer formed on the outer surface of the ink receiving inside layer.

6. The ink jet recording material as claimed in claim 5, wherein the ink receiving inside layer of the image-recording stratum contains fine particles of gel method-silica, and the ink receiving outermost layer contains fine pigment particles of at least one member selected from the group consisting of the silica compounds and of the alumina compounds.

7. The ink jet recording material as claimed in claim 6, wherein the fine pigment particles contained in the ink receiving outermost layer are secondary particles having an average secondary particle size of 800 nm or less and each consisting of a plurality of secondary particles having an average primary particle size of 3 to 50 nm and agglomerated with each other to form a secondary particle.

8. The ink jet recording material as claimed in claim 6, wherein the fine pigment particles contained in the ink receiving outermost layer are fine fumed silica particles.

9. The ink jet recording material as claimed in any one of claim 5 to 8, wherein the ink receiving outermost layer further contains a cationic compound.

10. The ink jet recording material as claimed in claim 9, wherein the ink receiving outermost layer is one formed by coating a coating liquid prepared by subjecting a mixture of the fine pigment particles and the cationic compound to a mechanical mix-dispersing procedure, on a substrate surface; and drying the coated coating liquid layer on the substrate surface.

11. The ink jet recording material as claimed in claim 6, wherein the fine silica particles contained in the ink receiving inside layers are porous particles each having a plurality of fine pores having an average pore size of 20 nm or less.

12. The ink jet recording material as claimed in claim 5, wherein the substrate exhibits non-absorbing property for aqueous liquids.

13. The ink jet recording material as claimed in claim 5, wherein at least one ink receiving inside layer is formed from an aqueous coating liquid containing the fine pigment particles and a binder on the substrate; and the ink receiving outermost layer is formed from an aqueous coating liquid containing the fine pigment particles and binder on an outermost surface of the ink receiving inside layer, the ink receiving outermost layer being formed in such a manner that the aqueous coating liquid for the ink receiving outermost layer is coated on the aqueous coating liquid layer for the ink receiving inside layer adjacent to the ink receiving outermost layer, before the aqueous coating liquid layer is dried, and the both the aqueous coating liquid strata for the ink receiving outermost layer and the ink receiving inside layer are simultaneously dried, to thereby enhance the ink image-receiving property and the surface smoothness of the image-recording stratum.

14. The ink jet recording material as claimed in claim 13, wherein the substrate is formed from an air-impermeable material.

15. The ink jet recording material as claimed in claim 14, wherein the air-impermeable material for the substrate is selected from laminate paper sheets comprising a support sheet consisting of a paper sheet and at least one air-impermeable coating layer formed on at least one surface of the support sheet and comprising a polyolefin resin.

16. The ink jet recording material as claimed in claim 13, wherein the ink receiving outermost layer further comprises a cationic compound.

17. The ink jet recording material as claimed in claim 13, wherein the ink receiving outermost layer exhibits a 75° specular surface gloss of 30% or more.

18. The ink jet recording material as claimed in claim 13, wherein the ink receiving inside layer and the ink receiving outermost layer are formed in such a manner that the coating procedure of the coating liquid for the ink receiving inside layer onto the substrate and the coating procedure of the coating liquid for the ink receiving outermost layer onto the adjacent ink receiving inside layer are substantially simultaneously carried out through a plurality of coating liquid-feeding slits of a multi-strata-coating apparatus.

19. The ink jet recording material as claimed in claim 18, wherein the simultaneous multi coating apparatus is selected from multi coating slot die coaters, multi coating slide die coaters, and multi coating curtain die coaters.

20. The ink jet recording material as claimed in claim 13, wherein the ink receiving inside layer and the ink receiving outermost layer are formed by such a manner that the coating procedure of the coating liquid for the ink receiving inside layer onto the substrate and the coating procedure of the coating liquid for the ink receiving outermost layer onto the adjacent ink receiving inside layer are successively carried out through a plurality of coating liquid-feeding slits of a plurality of coating apparatuses located independently of each other.

21. The ink jet recording material as claimed in claim 20, wherein the independent coating apparatuses are selected from slot die coaters, slide die coaters and curtain die coaters each having a single coating liquid-feeding slit.

22. The ink jet recording material as claimed in claim 1, wherein the fine particles of the alumina compounds have a BET specific area of 180 to 300 $m^2/g$.

23. The ink jet recording material as claimed in claim 1, wherein the fine particles of the alumina compounds are selected from rod-shaped fine particles of δ- and γ-aluminas having an average particle length of 300 nm or less.

24. The ink jet recording material as claimed in claim 1, wherein the fine particles of the θ-, δ- and γ-aluminas have a content of $Al_2O_3$ of 99.99% by weight or more.

25. The inkjet recording material as claimed in claim 1, wherein the fine particles of the θ-, δ- and γ-aluminas are selected from fumed θ-, δ- and γ-aluminas respectively.

26. The ink jet recording material as claimed in claim 1, wherein the at least one ink receiving layer of the image-recording stratum comprising the binder and the fine pigment particle of at least one pigment selected from the group consisting of silica, aluminosilicate and α-, θ-, δ and γ-aluminas and having an average particle size of 1 mm or less, further comprises a light resistance-enhancing agent for images comprising at least one member selected from the group consisting of phenolic compounds, boric acid, borate salts and cyclodextrin compounds.

27. The ink jet recording material as claimed in claim 26, wherein the image-recording stratum comprises a plurality of ink receiving layers superposed on each other, and an ink receiving layer located outermost of the image-recording stratum comprises the fine pigment particles and the binder, at least one ink receiving layer in the image-recording layer contains an image light resistance-enhancing agent comprising at least one member selected from the group consisting of phenolic compounds, boric acid, borate salts and cyclodextrin compounds.

28. The ink jet recording material as claimed in claim 26 or 27, wherein the phenolic compounds are selected from the group consisting of hydroquinone compounds, pyrocatechol compounds and phenolsulfonic acid compounds.

29. The ink jet recording material as claimed in claim 26 or 27, wherein the cyclodextrin compounds are selected from the group consisting of α-cyclodextrins, β-cyclodextrins, γ-cyclodextrins, alkylated cyclodextrins, hydroxyalkylated cyclodextrins, and cation-modified cyclodextrins.

30. The ink jet recording material as claimed in claim 26 or 27, wherein the cyclodextrin compounds are γ-cyclodextrins.

31. The ink jet recording material as claimed in claim 26 or 27, wherein the image light resistance-enhancing agent is contained in the ink receiving layer by coating the ink receiving layer with a solution of the image light resistance-enhancing agent and drying the coated solution.

32. The ink jet recording material as claimed in claim 26 or 27, wherein the content of the image light resistance enhancing agent in the ink receiving layer is 0.1 to 10 $g/m^2$.

33. The ink jet recording material as claimed in claim 26 or 27, wherein the fine pigment particles are fine particles of at least one member selected from fumed silica, amorphous silica, aluminas and alumina hydrates.

34. The inkjet recording material as claimed in claim 33, wherein the fumed silica particles are in the form of secondary particles having an average secondary particle size of 300 nm or less and each consisting of a plurality of primary particles having a primary particle size of 3 to 50 nm and agglomerated with each other.

35. The ink jet recording material as claimed in claim 26 or 27, wherein the ink receiving layer comprising the fine pigment particles and the binder further comprises a cationic compound.

36. The ink jet recording material as claimed in claim 26 or 27, wherein the binder comprises at least one member selected from the group consisting of water-soluble polymeric compounds, latices of copolymers of conjugated diene compounds, latices of vinyl copolymers, water-dispersible acrylic resins, water-dispersible polyester resins and water-dispersible polyurethane resins.

37. The ink jet recording material as claimed in claim 26 or 27, wherein the binder comprises at least one member selected from the group consisting of polyvinyl alcohol, partially saponificated polyvinyl alcohols, acetacetylated polyvinyl alcohols, silyl-modified polyvinyl alcohols, cation-modified polyvinyl alcohols, and anion-modified polyvinyl alcohols.

38. The ink jet recording material as claimed in claim 26 or 27, wherein the substrate is formed from a ink-nonabsorbing material.

39. The ink jet recording material as claimed in claim 26 or 27, wherein the surface of the image-recording stratum has a 75° specular gloss of 30% or more.

40. The ink jet recording material as claimed in claim 26, wherein the fine pigment particles contained in the ink receiving layer containing the image light resistance-enhancing agent are in the form of secondary particles having an average secondary particle size of 1 mm or less and each consisting of a plurality of primary particles having an average primary particle size of 3 to 40 nm and agglomerated with each other.

* * * * *